US007444102B2

(12) United States Patent
Kishigami

(10) Patent No.: US 7,444,102 B2
(45) Date of Patent: Oct. 28, 2008

(54) IMAGE FORMING APPARATUS AND IMAGE FORMING SYSTEM INCORPORATING THE SAME

(75) Inventor: Minoru Kishigami, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 189 days.

(21) Appl. No.: 11/410,273

(22) Filed: Apr. 24, 2006

(65) Prior Publication Data

US 2006/0257168 A1 Nov. 16, 2006

(30) Foreign Application Priority Data

Apr. 26, 2005 (JP) ..... 2005-128637

(51) Int. Cl.
*G03G 15/01* (2006.01)

(52) U.S. Cl. ..... 399/227

(58) Field of Classification Search ..... 399/227
See application file for complete search history.

(56) References Cited

U.S. PATENT DOCUMENTS

| | | | | |
|---|---|---|---|---|
| 4,684,864 A | | 8/1987 | Morimoto | |
| 5,552,877 A | * | 9/1996 | Ishikawa et al. | 399/227 |

FOREIGN PATENT DOCUMENTS

| | | | |
|---|---|---|---|
| DE | 19514664 | | 10/1995 |
| EP | 1508840 | | 2/2005 |
| JP | 61-244300 | | 10/1986 |
| JP | 05-241418 | | 9/1993 |
| JP | 2003270939 A | * | 9/2003 |

OTHER PUBLICATIONS

Sax, H., "Stepper Motor Driving", SGS-Thomson Microelectronics, 1995, pp. 1-17.
"Stepper Motor System Basics", Advanced Micro Systems, Inc., Step Motors Reference Guide, pp. 1-9.

* cited by examiner

*Primary Examiner*—Ryan Gleitz
(74) *Attorney, Agent, or Firm*—Hogan & Hartson LLP

(57) ABSTRACT

A rotary member has a plurality of loading sections each of which is adapted to accommodate a developing device operable to develop an electrostatic latent image formed on an image carrier. The rotary member is rotatable between a plurality of stop positions. A motor is operable to exert a torque on the rotary member, the torque including a first torque, a second torque lower than the first torque, and a third torque lower than the second torque. A controller is operable to cause the motor to exert the first torque to rotate the rotary member, and to cause the motor to interchange the torque between the second torque and the third torque to retain the rotary member at one of the stop positions.

10 Claims, 11 Drawing Sheets

IMAGE FORMING APPARATUS AND IMAGE FORMING SYSTEM INCORPORATING THE SAME

BACKGROUND OF THE INVENTION

The present invention relates to an image forming apparatus and an image forming system incorporating the same.

An image forming apparatus, such as a laser beam printer, has already been well known. Such an image forming apparatus comprises, for example, an image carrier for carrying a latent image thereon; developing devices, each of which develops the latent image carried on the image carrier with use of a developing agent; a rotary member having a plurality of loading sections allowing removable loading of the developing devices; and a motor for rotating the rotary member.

When an image signal is transmitted from an external apparatus, such as a host computer, to the image forming apparatus, the rotary member is rotated by driving force of the motor, so that the developing device is placed at the development position opposing the image carrier. The latent image carried on the image carrier is developed with the developing agent stored in the developing device, to thus form a visible image, and the visible image is transferred onto a medium, thereby eventually forming an image. Such an image forming apparatus is disclosed in Japanese Patent Publication No. 5-241418A, for example.

Although the rotary member repeats rotation and stopping, some types of the motor are provided with not only the function of rotating the rotary member, but also the function of retaining the rotary member at a stop position when the rotary member is at a standstill.

However, when the motor retains the rotary member at the stop position, power is supplied to the motor. Therefore, electric power is consumed. Hence, a measure for suppressing the electric power consumed by the motor when the motor retains the rotary member at the stop position is requested.

SUMMARY OF THE INVENTION

It is therefore an object of the invention to provide an image forming apparatus which can suppress electrical power consumption appropriately.

It is also an object of the invention to provide an image forming system incorporating such an image forming apparatus.

In order to achieve at least one of the above objects, according to the invention, there is provided an image forming apparatus, comprising:

a rotary member, having a plurality of loading sections each of which is adapted to accommodate a developing device operable to develop an electrostatic latent image formed on an image carrier, the rotary member being rotatable between a plurality of stop positions;

a motor, operable to exert a torque on the rotary member, the torque including a first torque, a second torque lower than the first torque, and a third torque lower than the second torque; and a controller, operable to cause the motor to exert the first torque to rotate the rotary member, and to cause the motor to interchange the torque between the second torque and the third torque to retain the rotary member at one of the stop positions.

With this configuration, there can be realized an image forming apparatus which can suppress power consumption appropriately.

The controller may control current supplied to the motor to exert one of the first torque, the second torque, and the third torque.

The stop positions may include a position that the developing device accommodated in one of the loading sections is opposed to the image carrier.

The motor may be a stepping motor. The controller may cause the motor to increase the torque from the third torque to the second torque before the rotary member is rotated.

In this case, malfunctions of the stepping motor can be appropriately prevented.

The torque may include a fourth torque lower than the third torque. The controller may cause the motor to exert the fourth torque in a case where a color of developing agent contained in the developing device accommodated in one of the loading sections is identical with a color of developing agent contained in the developing device accommodated with any one of the loading sections, and a plurality of monochrome images are continuously formed.

In this case, power consumption can be further suppressed.

Here, the motor may be a stepping motor. The torque may include a fifth torque lower than the first torque but higher than the second torque. The controller may cause the motor to increase the torque from the fourth torque to the fifth torque before the rotary member is rotated.

In this case, malfunctions of the stepping motor can be appropriately prevented.

The image forming apparatus may further comprise a roller driver, adapted to rotate a developing roller provided in the developing device which is operable to supply developing agent to the image carrier to develop the latent image. The controller may cause the motor to decrease the torque from the second torque to the third torque after the roller driver starts rotating the developing roller.

In this case, the rotary member is retained at the stop position without fail even in a condition where the rotary member easily rotates.

The image forming apparatus may further comprise:

a plurality of engagement members, each of which is associated with one of the stop positions and is provided on the rotary member; and a retainer, operable to engage with one of the engagement members when the rotary member is placed in one of the stop positions.

In this case, the rotary member can be retained at the stop position more reliably.

The retaining member may be comprised of resin.

In this case, the noise caused by engagement between the retainer and the engagement member can be suppressed.

In order to achieve at least one of the objects, according to the invention, there is also provided an image forming system, comprising:

the above image forming apparatus; and a computer, communicatively connected to the image forming apparatus and operable to cause the image forming apparatus to execute an image forming operation.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE EMBODIMENTS

Embodiments of the invention will be described below in detail with reference to the accompanying drawings.

Figure 1:
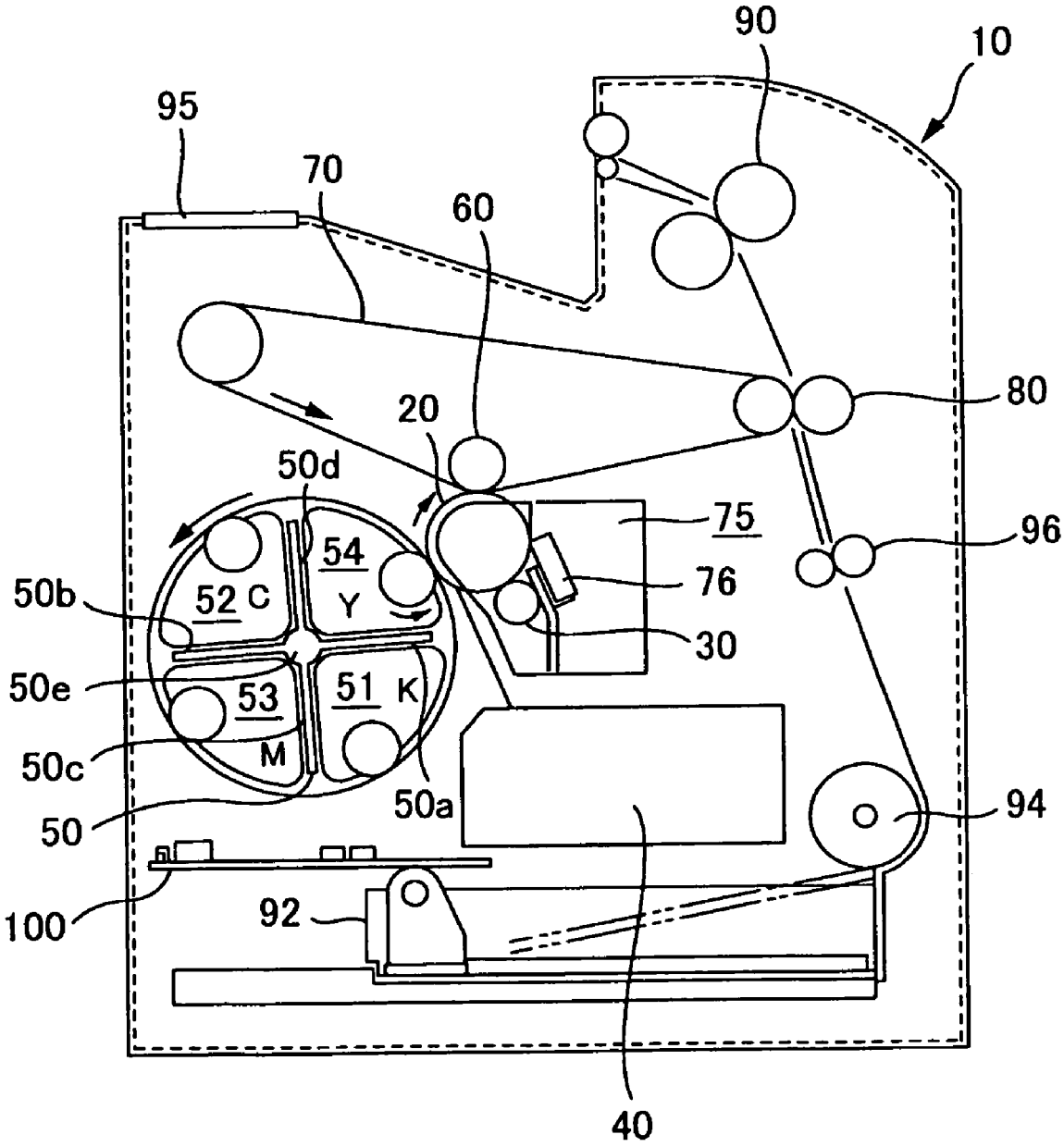
FIG. 1 is a schematic section view of a printer according to one embodiment of the invention, showing a state that the printer is used as a color printer.
Figure 2:
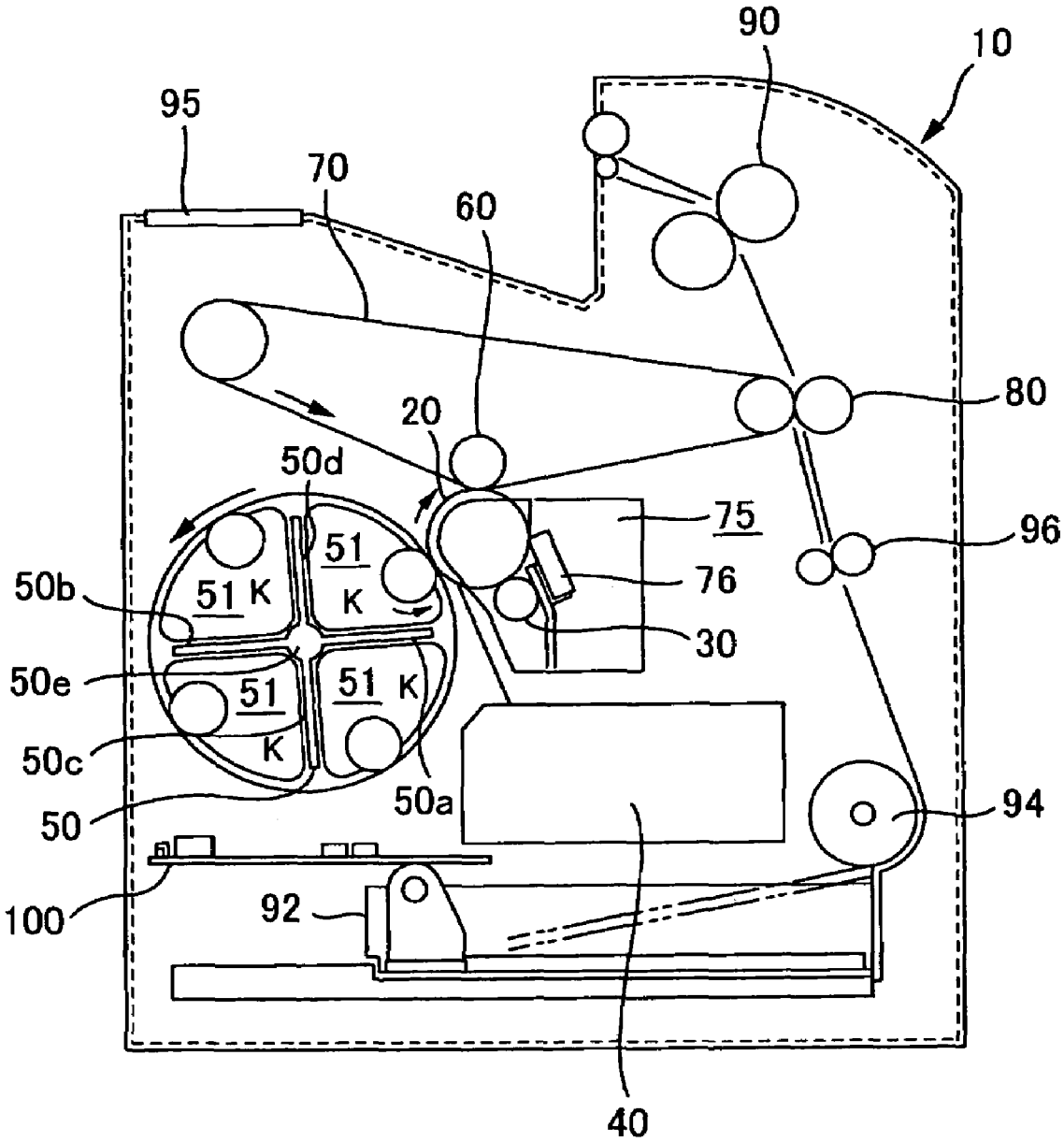
FIG. 2 is a schematic section view of the printer, showing a state that the printer is used as a monochrome printer.

As shown in FIGS. 1 and 2, a printer 10 according to one embodiment of the invention has, along a rotational direction of a photosensitive body 20 serving as an image carrier for carrying a latent image thereon, a charging unit 30, an exposing unit 40, a developing device holder 48, a primary transferring unit 60, an intermediate transferring member 70, and a cleaning unit 75. The printer 10 further has a secondary transferring unit 80; a fusing unit 90; a display unit 95 provided with a liquid crystal panel or the like; and a control unit 100 which controls these units and manages operation of the printer.

The photosensitive body 20 has a cylindrical, conductive substrate and a photosensitive layer formed on the circumferential surface thereof. The photosensitive body 20 can rotate about a center axis; in the present embodiment, can rotate clockwise as indicated by an arrow in each of FIGS. 1 and 2.

The charging unit 30 is a unit for charging the photosensitive body 20. The exposing unit 40 is a unit for irradiating the charged photosensitive body 20 with a laser beam to thereby form a latent image thereon. The exposing unit 40 comprises a semiconductor laser, a polygon mirror, an F-θ lens, and the like, and emits a laser beam which has been modulated in accordance with image information input from an unillustrated external device such as a personal computer, a word processor.

The developing device holder 48 has a rotary 50. The rotary 50 is equipped with a plurality of loading sections 50*a*, 50*b*, 50*c*, and 50*d*, each of which allows removable loading of a developing device for developing a latent image formed on the photosensitive body 20 through use of toner T stored therein.

Meanwhile, the printer 10 according to the present embodiment can be used as a color printer capable of forming a full-color image. In addition, the printer 10 can be used as a monochrome printer capable of forming a monochrome image.

When the printer 10 is used as a color printer, four developing devices; namely, the black developing device 51, a magenta developing device 52, a cyan developing device 53, and a yellow developing device 54, are inserted respectively to the plurality of loading sections 50*a*, 50*b*, 50*c*, and 50*d* of the rotary 50, as shown in FIG. 1. The latent image formed on the photosensitive body 20 is then developed with the toner T stored in the respective developing devices.

The rotary 50 can move the four developing devices 51, 52, 53, and 54 by rotation. More specifically, the four developing devices 51, 52, 53, and 54 can rotate around a rotary shaft 50*e* while maintaining their relative positions. Every time formation of an image of one page is completed, the developing device selectively opposes the photosensitive member 20 by rotating the rotary 50 by 90 degrees, so that the latent image formed on the photosensitive member 20 is sequentially developed with the toner T stored in the developing devices 51, 52, 53, and 54.

Meanwhile, when the printer 10 is used as a monochrome printer, as shown in FIG. 2, a plurality of developing devices in which a developing agent of a single color are stored are respectively loaded to the four loading sections 50*a*, 50*b*, 50*c*, and 50*d* of the rotary 50. The latent image formed on the photosensitive body 20 is then developed with use of the toner T of the single color. In the present embodiment, the black developing devices 51 are loaded to the four loading sections 50*a*, 50*b*, 50*c*, and 50*d*, thereby allowing the printer 10 to be used as a monochrome printer. The rotary 50 is rotated, thereby moving one of the thus-loaded four black developing devices 51 to the position opposing the photosensitive body 20. The latent image formed on the photosensitive body 20 is developed with the black toner T stored in a black developing device 51, among the four black developing devices being loaded, which has moved to the position opposing the photosensitive body 20.

The primary transferring unit 60 is a unit for transferring, onto the intermediate transferring unit 70, a toner image formed on the photosensitive body 20.

The intermediate transferring unit 70 is a multilayer endless belt formed by providing a tin-deposited layer on the surface of a PET film, and further forming a semi-conductive coating layer on the surface of the tin-deposited layer. The intermediate transferring member 70 is circulated at a velocity which is substantially the same as a circumferential velocity of the photosensitive body 20.

The secondary transferring unit 80 is a unit for transferring onto a medium, such as paper, a film, or cloth, a toner image formed on the intermediate transferring unit 70.

The fusing unit 90 is a unit for fusing the toner image transferred onto the medium, thereby rendering an image permanent.

The cleaning unit 75 is disposed between the primary transferring unit 60 and the charging unit 30, and has a rubber cleaning blade 76 remaining in contact with the surface of the photosensitive body 20. The cleaning unit 75 is a unit for, after a toner image has been transferred onto the intermediate transferring unit 70 by the primary transferring unit 60, scraping off and removing the toner T still remaining on the photosensitive body 20 by the cleaning blade 76.

The rotary 50 can be equipped with the black developing device 51 containing black (K) toner, the magenta developing device 52 containing magenta (M) toner, the cyan developing device 53 containing cyan (C) toner, and the yellow developing device 54 containing yellow (Y) toner. Since the respective developing devices have the same configuration, the configuration of the yellow developing device 54 will now be described.

Figure 3:
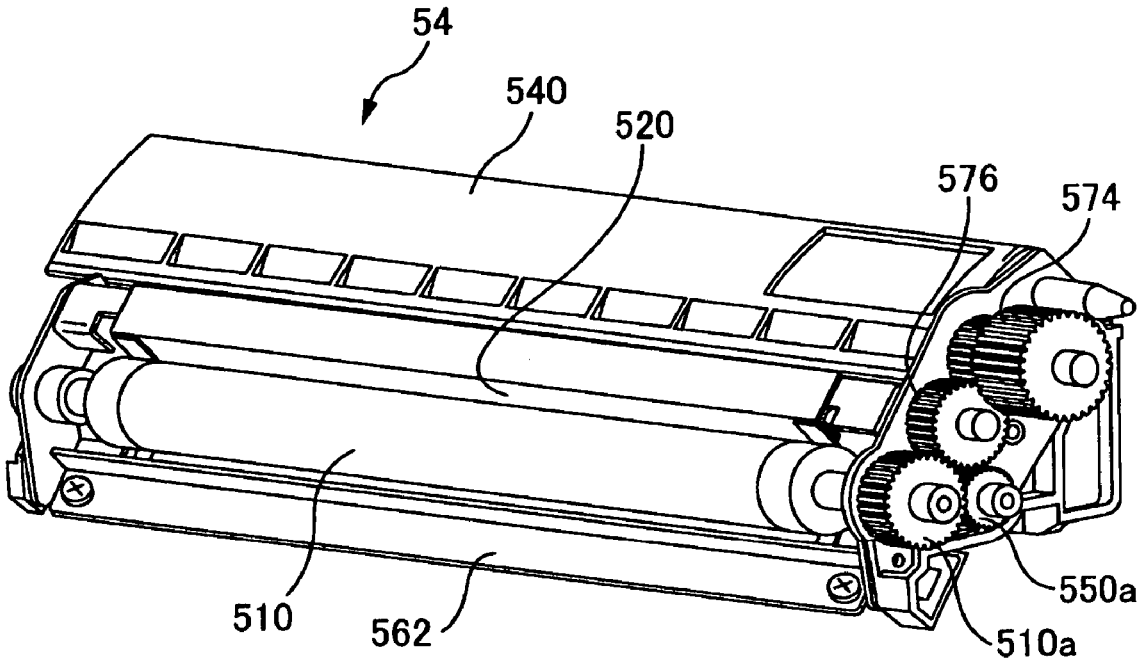
FIG. 3 is a perspective view of a yellow developing device in the printer.
Figure 4:
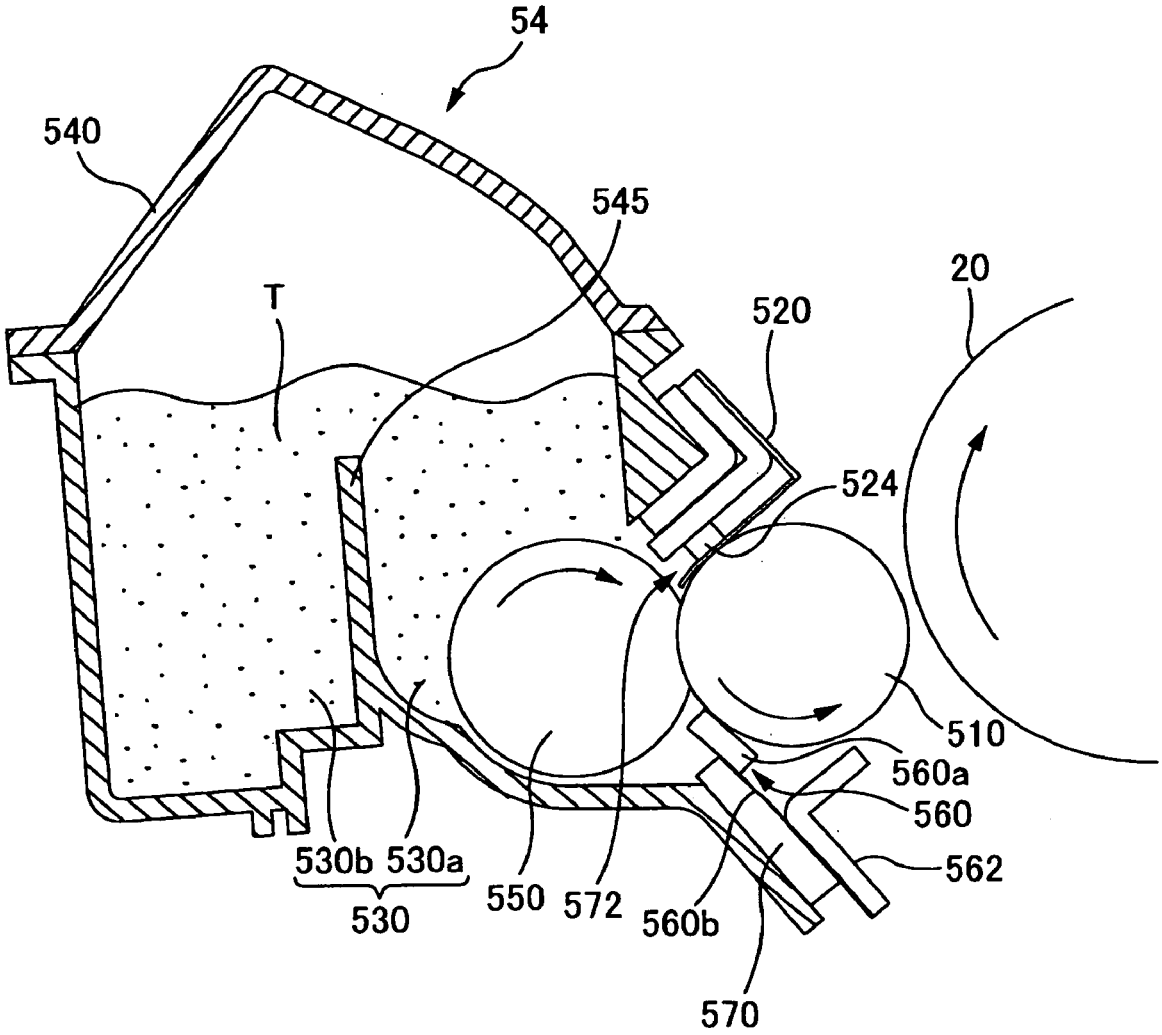
FIG. 4 is a vertical section view of the yellow developing device.

As shown in FIGS. 3 and 4, the yellow developing device 54 comprises the developing roller 510, a sealing member

520, a toner storage section 530, a housing 540, a toner supplying roller 550 and a control blade 560.

The developing roller 510 carries thereon and transports toner T to the developing position opposing the photosensitive body 20. As shown in FIG. 3, the developing roller 510 is supported at both longitudinal ends thereof and can rotate around the center axis thereof. As shown in FIG. 4, the developing roller 510 rotates in a direction (the counterclockwise direction in this figure) opposite the rotational direction (the clockwise direction in this figure) of the photosensitive body 20. The center axis of the developing roller 510 is located at a position that is lower than the center axis of the photosensitive body 20. A roller driving gear 510*a* for driving the developing roller 510 is disposed on one longitudinal end of the developing roller 510.

As shown in FIG. 4, a gap exists between the developing roller 510 and the photosensitive body 20, with the yellow developing device 54 opposing the photosensitive body 20. In short, the black developing device 51 develops the latent image formed on the photosensitive body 20 in a non-contact manner. When the latent image formed on the photosensitive body 20 is developed, an alternating electric field develops between the developing roller 510 and the photosensitive body 20.

The sealing member 520 prevents leakage of the toner T out of the black developing device 51, and recovers the toner T on the developing roller 510, which has passed by the developing position, into the developing device without scraping it off the developing roller. The sealing member 520 is a seal which is made of a polyethylene film, or the like. The sealing member 520 is supported by a supporting plate 522, and is mounted on the housing 540 by way of this supporting plate 522. A side of the sealing member 520 opposite to the side thereof opposing the development roller 510 is provided with an impelling member 524 made of mortoprain, or the like. The sealing member 520 is pressed against the developing roller 510 by elastic force of the impelling member 524. The location where the sealing member 520 comes into contact with the developing roller 510 is higher than the center axis of the developing roller 510.

The housing 540 is manufactured by welding together a plurality of integrally-molded housing members; that is, an upper housing member 542 and a lower housing member 544. The inside of the housing 540 is divided into two toner storage sections 530; namely, a first toner storage section 530*a* and a second toner storage section 530*b*, by a partition 545 which vertically protrudes from an inner wall for partitioning the toner T.

A stirring member for stirring the toner T may be provided in the toner storage section 530. However, in the present embodiment, the respective developing devices (the black developing device 51, the magenta developing device 52, the cyan developing device 53, and the yellow developing device 54) rotate in association with the rotation of the developing unit holding unit 49. Thus, the toner T in the respective developing devices is stirred, and hence the stirring member is not provided in the toner storage section 530. The upper portion of the first toner storage section 530*a* is in communication with that of the second toner storage section 530*b*; and the movement of toner T is regulated by the partition 545. However, when the rotary 50 rotates, the toner T stored in the first toner storage section 530*a* and the second toner storage section 530*b* is temporarily collected to a side where the first and second storage sections are in communication; that is, the upper side at the developing position. When the rotary returns to the state shown in FIG. 4, the thus-collected toner T is mixed, and returned into the first toner storage section 530*a* and the second toner storage section 530*b*. In other words, the toner T inside the developing device is appropriately stirred by rotation of the rotary 50. Therefore, in the present embodiment, a stirring member is not provided in the toner storage section 530. However, there may be provided a stirring member for stirring the toner T stored in the toner storage section 530.

An opening 572 is formed in a lower portion of the housing 540 (the first toner storage section 530*a*), and the developing roller 510 is arranged in the opening 572, with a portion of the developing roller 510 being exposed.

The toner supplying roller 550 is disposed in the first toner storage section 530*a*, and supplies to the developing roller 510 the toner T stored in the first toner storage section 530*a*. The toner supplying roller 550 is made of polyurethane foam, or the like, and remains in contact with the developing roller 510 while being elastically deformed. The toner supplying roller 550 is provided in a lower portion of the toner storage section 530. The toner T stored in the toner storage section 530 is supplied to the developing roller 510 by the toner supplying roller 550 at the lower portion of the toner storage section 530.

As shown in FIG. 4, the toner supplying roller 550 is capable of rotating about the center axis thereof, and the center axis is located in a position that is lower than the center axis of the developing roller 510. The toner supplying roller 550 rotates in a direction (the clockwise direction in this figure) opposite the rotational direction of the development roller 510 (the counterclockwise direction in this figure). The toner supplying roller 550 has the function of stripping off the toner T, which still remains on the developing roller 510 after developing operation, from the developing roller 510 as well as the function of supplying to the developing roller 510 the toner T stored in the toner storage section 530.

As shown in FIG. 3, a roller driving gear 550*a* for driving the toner supplying roller 550 is disposed on one longitudinal end of the toner supplying roller 550.

The control blade 560 electrically charges the toner T carried by the developing roller 510, and regulates the thickness of the toner T carried by the developing roller 510. This control blade 560 has a rubber section 560*a* and a supporting section 560*b*. The rubber section 560*a* is made of a silicone rubber, a urethane rubber, or the like. The supporting section 560*b* is an elastic plate member which is made of phosphor bronze, stainless steel, or the like. The rubber section 560*a* is supported by the supporting section 560*b*. The supporting section 560*b* is fastened to the housing 540 via a supporting plate 562. In addition, an impelling member 570 made of mortoprain, or the like, is disposed on a side of the control blade 560 opposite the side thereof facing the developing roller 510.

The rubber section 560*a* is pressed against the developing roller 510 by elastic force stemming from flexure of the supporting section 560*b*. In addition, the impelling member 570 prevents the toner T from entering between the rubber support section 560*b* and the housing 540 to thereby stabilize the elastic force stemming from flexure of the supporting section 560*b*; and impels the rubber section 560*a* toward the developing roller 510 from the right behind of the rubber section 560*a*, thereby pressing the rubber section 560*a* against the developing roller 510. Therefore, the impelling member 570 enhances uniform contact of the rubber section 560*a* against the developing roller 510.

In addition to the roller driving gear 510*a* and the roller driving gear 550*a*, the yellow developing device 54 comprises a device driving gear 574 and an intermediate gear 576.

The device driving gear 574 is a gear for transmitting, in a state in which the yellow developing device 54 is loaded to the loading section, a driving force to the roller driving gear 510*a* and the roller driving gear 550*a* upon receipt of a driving force from a printer main body; more specifically, from a device driving gear 220*c* which is disposed on the printer main body.

The intermediate gear 576 is a gear serving as an idler gear in transmission of a driving force to the roller driving gear 510*a* and the roller driving gear 550*a* by the device driving gear 574. More specifically, the device driving gear 574 receives the driving force from the printer main body in a state in which the yellow developing device 54 is loaded to the loading section, and transmits the driving force to the roller driving gear 510*a* and the roller driving gear 550*a* by way of the intermediate gear 576.

Figure 5:
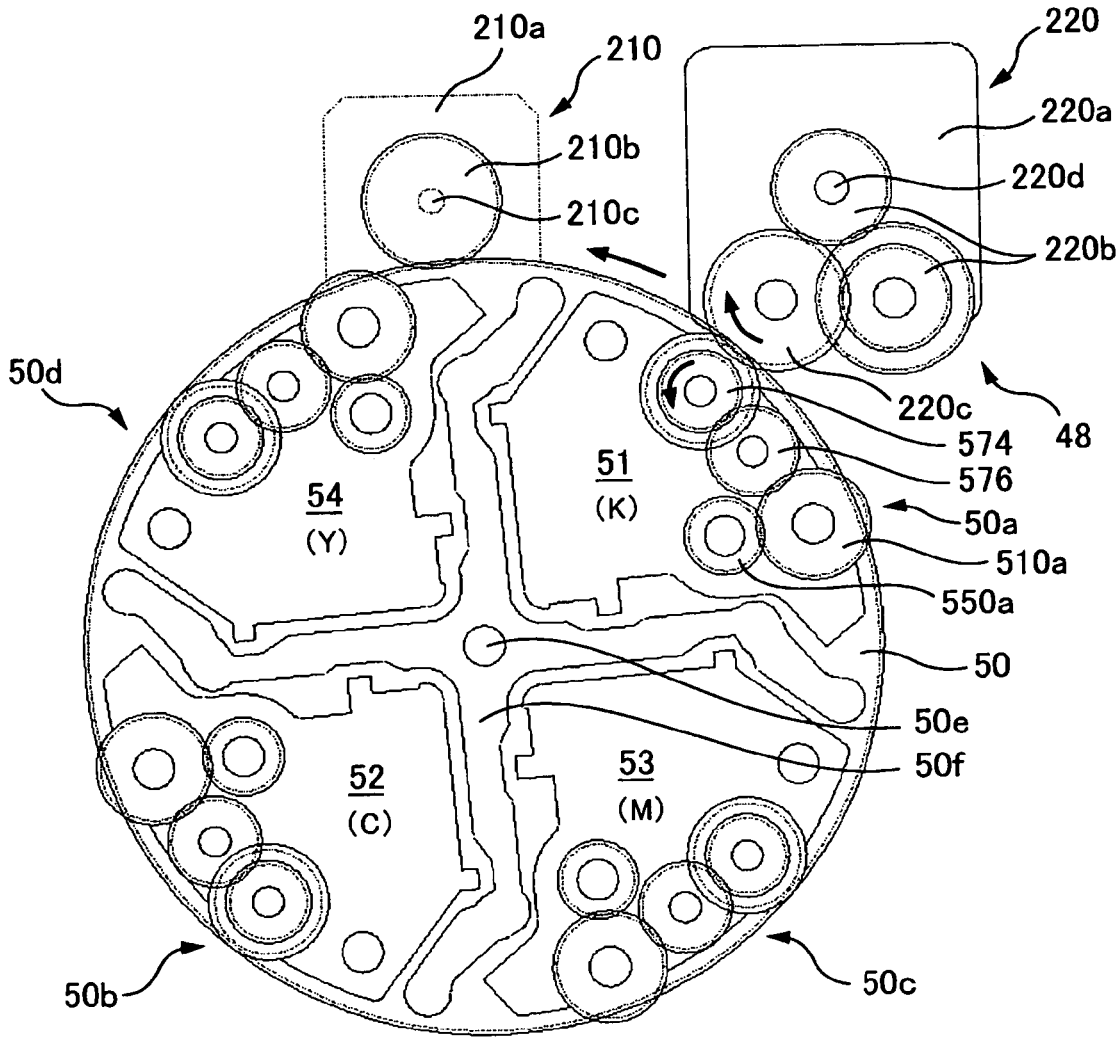
FIG. 5 is a section view of a first part of a developing device holder in the printer.

As shown in FIG. 3, the device driving gear 574 and the intermediate gear 576 are engaged together; the intermediate gear 576 and the roller driving gear 510*a* are engaged together; and the roller driving gear 510*a* and the roller driving gear 550*a* are engaged together. As shown in FIG. 5, the device driving gear 574 is engaged with the device driving gear 220*c* disposed on the printer main body.

In the yellow developing device 54 configured as above, the toner supplying roller 550 supplies the toner T stored in the toner storage section 530 to the developing roller 510. In association with rotation of the developing roller 510, the toner T supplied to the developing roller 510 reaches a contact position of the control blade 560. During the course of passing by the abutting position, the toner T is electrically charged, and subjected to layer thickness regulation. By further rotation of the developing roller 510, the toner T on the developing roller 510, which has undergone layer thickness regulation, arrives at the developing position opposing the photosensitive body 20. In the developing position, the toner T is used for developing the latent image formed on the photosensitive body 20 under the alternating electric field. By still further rotation of the developing roller 510, the toner T on the developing roller 510, which has passed by the developing position, passes by the sealing member 520, and is collected into the developing device without being scraped off by the sealing member 520. The toner T still remaining on the developing roller 510 can be scraped off by the toner supplying roller 550.

As described above, the developing device holder 48 has the rotary 50 which can rotate; and the rotary 50 has the plurality of loading sections 50*a*, 50*b*, 50*c*, and 50*d* to which the developing devices 51, 52, 53, and 54 can be loaded. The black developing device 51 can be loaded to the loading section 50*a*, the cyan developing device 52 or the black developing device 51 can be loaded to the loading section 50*b*, the magenta developing device 53 or the black developing device 51 can be loaded to the loading section 50*c*, and the yellow developing device 54 or the black developing device 51 can be loaded to the loading section 50*d*. The developing device holder 48 can rotate about the rotary shaft 50*e* while retaining these developing devices to the loading sections. The developing device holder 48 is configured such that the developing devices loaded to the loading sections move in accordance with rotation of the developing device holder 48.

Figure 6:
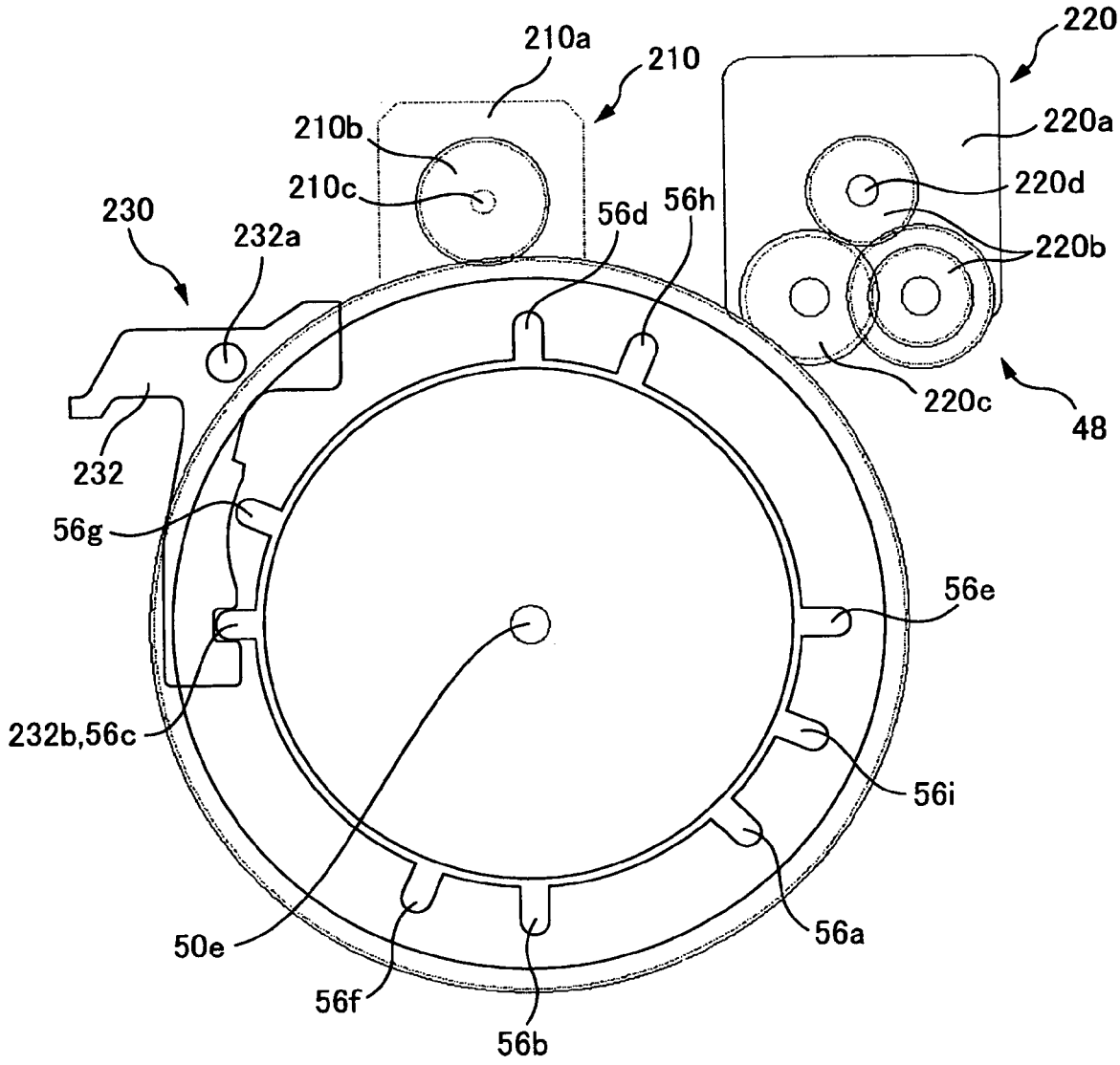
FIG. 6 is a section view of a second part of the developing device holder.

The configuration of the developing device holder 48 will now be described in more detail by reference to FIGS. 5 to 7F. FIGS. 5 and 6 show a state in which the rotary 50 is positioned at a developing position of the black developing device 51.

The developing device holder 48 comprises the above-described rotary 50, a rotary driver 210, a developing device driver 220, and a rotary retainer 230.

The rotary shaft 50*e* extends horizontally between two frame side plates (not shown) forming an enclosure of the printer 10, and is supported at both ends thereof. The supporting frame 58 is mounted to the rotary shaft 50*e*. The four loading sections 50*a*, 50*b*, 50*c*, and 50*d*, which removably retain the above-described developing devices 51, 52, 53, and 54 around the rotary shaft 50*e*, are provided on the supporting frame 58 while being spaced apart from each other through 90 degrees in the circumferential direction.

Figure 7A:
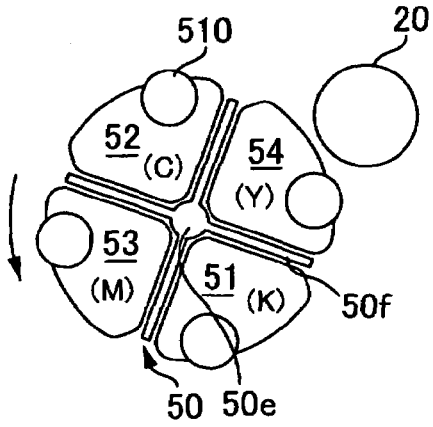
FIGS. 7A to 7F are schematic views showing respective stop positions of the developing device holder.
Figure 7B:
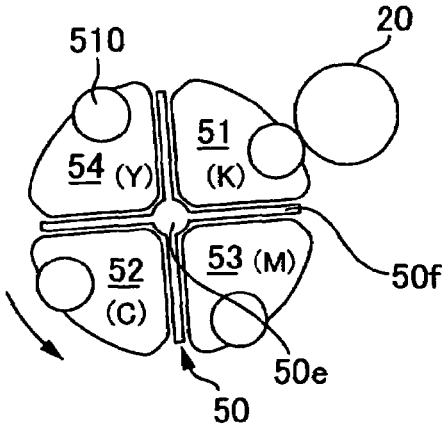
Figure 7C:
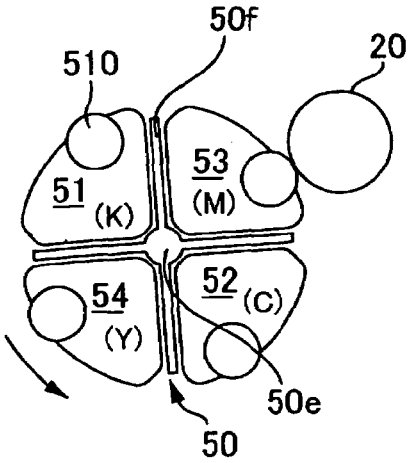
Figure 7D:
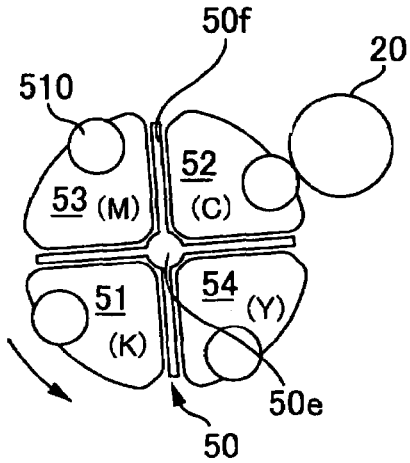
Figure 7E:
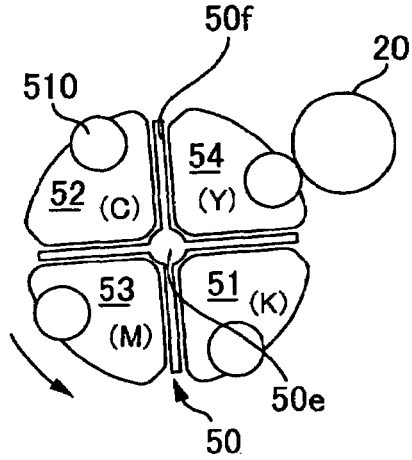
Figure 7F:
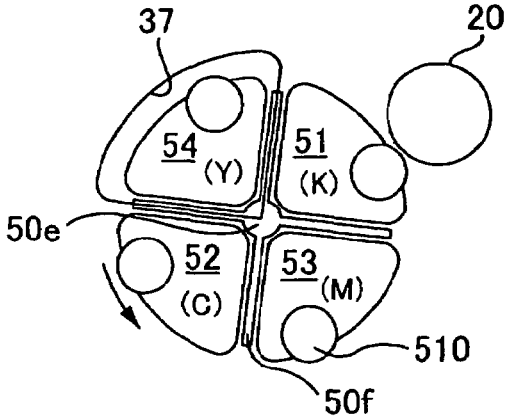

Descriptions about six stop positions of the rotary 50 which rotates will now be provided by reference to FIGS. 7A to 7F. FIG. 7A shows a stand-by position for a time period when the rotary 50 is on stand-by for image formation; that is, the position which serves as a home position. The home position serves as a reference position of the rotary 50 in the rotation direction. FIG. 7B shows a developing position of the developing device loaded to the developing device 50*a*. FIG. 7C shows a developing position of the developing device loaded to the developing device 50*c*. FIG. 7D shows a developing position of the developing device loaded to the developing device 50*b*. FIG. 7E shows a developing position of the developing device loaded to the developing device 50*d*. FIG. 7F shows a replacement position to which the developing device to be loaded to the developing device 50*d* is loaded.

First, the home position shown in FIG. 7A will be described. A home position detector 31 for detecting the home position is provided at one axial end of the rotary shaft 50*e* of the rotary 50. The home position detector 31 comprises a disk, that is fastened to one end of the rotary shaft 50*e* and is to be used for generating a signal; and a home position sensor consisting of a photo-interrupter having a light-emitting section and a light-receiving section, or the like. A brim portion of the disk is arranged to reach a position between the light-emitting section and the light-receiving section of the home position sensor. When slit sections formed in the disk have moved to the detecting position of the home position sensor, a signal output from the home position sensor changes from "L" to "H." The home position of the rotary 50 is detected on the basis of the change in the signal level and the number of pulses of the pulse motor. The respective developing devices can be placed in the developing position, or the like, by taking the home position as a reference.

FIG. 7B shows the developing position of the developing device loaded to the loading section 50*a* (i.e., the black developing device 51), which is a position to be reached when the pulse motor is rotated by an amount corresponding to a given number of pulses from the home position. When the rotary 50 is positioned at the developing position of the black developing device 51, the black developing device 51 opposing the photosensitive body 20 develops the latent image formed on the photosensitive body 20. When the rotary 50 rotates 90 degrees counterclockwise, the rotary 50 is positioned at the developing position of the developing device (e.g., the magenta developing device 53) loaded to the loading section 50*c* as shown in FIG. 7C. When the rotary 50 further rotates 90 degrees counterclockwise, the rotary 50 is positioned at the developing position of the developing device (e.g., the cyan developing device 52) loaded to the loading section 50*b* as shown in FIG. 7D. When the rotary 50 further rotates 90 degrees counterclockwise, the rotary 50 is positioned at the developing position of the developing device (e.g., the yellow developing device 54) loaded to the loading section 50*d* as shown in FIG. 7E.

FIG. 7F shows a replacement position to which the developing device (e.g., the yellow developing device 54) to be loaded to the developing device 50*d* is loaded. A replacement port 37 through which only a single developing device can pass, and a door cover (not shown) for covering the replacement port 37 are disposed on one of the foregoing two frame side plates. As shown in FIG. 7F, the replacement port 37 is formed at a position which allows loading of the developing device (e.g., the yellow developing device 54) only to the loading section 50*d* in positioning of the rotary 50 at this replacement position. During a period when the rotary 50 is positioned at a position other than this replacement position, loading of the developing device to the loading section 50*d* is restricted by the frame side plates. Meanwhile, although the replacement position for the loading section 50*d* is indicated as an example in FIG. 7F, positions at which the rotary 50 is positioned when the same is rotated in 90 degrees increments correspond to the respective loading sections 50*a*, 50*b*, and 50*c*.

The rotary driver 210 is provided for rotating the rotary 50. As shown in FIG. 5, the rotary driver 210 comprises a first stepping motor 210*a* and a rotary driving gear 210*b*.

The first stepping motor 210*a* is a motor for rotating the rotary 50. The first stepping motor 210*a* comprises a motor shaft 210*c*, which is fixed to the rotary driving gear 210*b*. The first stepping motor 210*a* rotates the rotary 50 by way of the rotary driving gear 210*b*. The rotary driving gear 210*b* is engaged with teeth formed on the periphery of the rotary 50, and drives (rotates) the rotary 50 upon receipt of a driving force from the first stepping motor 210*a*.

Meanwhile, the first stepping motor 210*a* is provided with not only the function of rotating the rotary 50, but also the function of retaining the rotary 50 at a stop position during a period when the rotary 50 is at a standstill. More specifically, the first stepping motor 210*a* is provided with a retaining mode for retaining an object of interest at the stop position, in addition to a rotating mode for rotating the object of interest. When the rotary 50 is positioned at the stop position, the first stepping motor 210*a* is still activated but is tuned into a retaining mode (described later in detail).

The developing device driver 220 is provided for rotating the developing roller 510 and the toner supplying roller 550 disposed in the developing device. As shown in FIG. 5, the developing device driver 220 comprises a second stepping motor 220*a*, a group of intermediate gears 220*b*, and the device driving gear 220*c*.

The second stepping motor 220*a* is provided for rotating the developing roller 510 and the toner supplying roller 550 so as to cause the developing device to develop a latent image. The second stepping motor 220*a* comprises a motor shaft 210*d* which is fixed to one gear of the group of intermediate gears 220*b*. The second stepping motor 220*a* rotates the developing roller 510 and the toner supplying roller 550 by way of the group of intermediate gears 220*b*, the device driving gear 220*c*, and the four gears (the device driving gear 574, the intermediate gear 576, the roller driving gear 510*a*, and the roller driving gear 550*a*) disposed in the developing device.

The device driving gear 220*c* drives (rotates) the developing roller 510 and the toner supplying roller 550 upon receipt of a driving force from the second stepping motor 220*a*. The device driving gear 220*c* is configured so as to be engaged with the device driving gear 574 disposed in the developing device, when the rotary 50 is rotated and positioned at the developing position of the developing device. More specifically, when the rotary 50 is rotated and positioned at the developing position (FIG. 7B) of the developing device (i.e., the black developing device 51) loaded to the loading section 50*a*, the device driving gear 220*c* engages with the device driving gear 574 disposed in the developing device 50*a*. When the rotary 50 is positioned at the developing position (FIG. 7C) of the developing device (i.e., the magenta developing device 53) loaded to the loading section 50*c*, the device driving gear 220*c* engages with the device driving gear 574 disposed in the developing device 50*c*. When the rotary 50 is positioned at the developing position (FIG. 7D) of the developing device (i.e., the cyan developing device 52) loaded to the loading section 50*b*, the device driving gear 220*c* engages with the device driving gear 574 disposed in the developing device 50*b*. When the rotary 50 is positioned at the developing position (FIG. 7E) of the developing device (i.e., the yellow developing device 54) loaded to the loading section 50*d*, the device driving gear 220*c* engages with the device driving gear 574 disposed in the developing device 50*d*. Hence, the device driving gear 220*c* transmits the driving force received from the second stepping motor 220*a* to the device driving gear 574 engaged therewith.

The rotary retainer 230 is provided for retaining the rotary 50 at each of the stop positions shown in FIGS. 7A to 7F. As shown in FIG. 6, the rotary retainer 230 comprises a retaining lever 232 and an unillustrated solenoid.

The retaining lever 232 is a lever made of a resin for retaining the rotary 50 during a period when the rotary 50 is at a standstill. The retaining lever 232 has a pivot 232*a*, and a recess 232*b* formed in an extremity of the retaining lever 232. When the rotary 50 is positioned at one of the stop positions shown in FIGS. 7A to 7F, the retaining lever 232 is driven by the solenoid, to thus be pivoted about the pivot 232*a*, and fits on one of the protrusions 56*a*, 56*b*, 56*c*, 56*d*, 56*e*, 56*f*, 56*g*, 56*h*, and 56*i* disposed on the rotary 50. As a result, the rotary 50 is retained at the stop position.

When the stop position where the rotary 50 stops changes, the protrusion on which the recess 232*b* is to be fitted also changes. More specifically, when the rotary 50 is positioned at the home position, the recess 232*b* fits on the protrusion 56*a*. When the rotary 50 is positioned at the developing position, the recess 232*b* fits on any one of the protrusions 56*b*, 56*c*, 56*d*, and 56*e*. When the rotary 50 is positioned at the replacement position, the recess 232*b* fits on any one of the protrusions 56*f*, 56*g*, 56*h*, and 56*i*.

As described above, the printer 10 comprises the first stepping motor 210*a* and the retaining lever 232 as members for retaining the rotary 50 at the stop position during a period when the rotary 50 is at a standstill.

Figure 8:
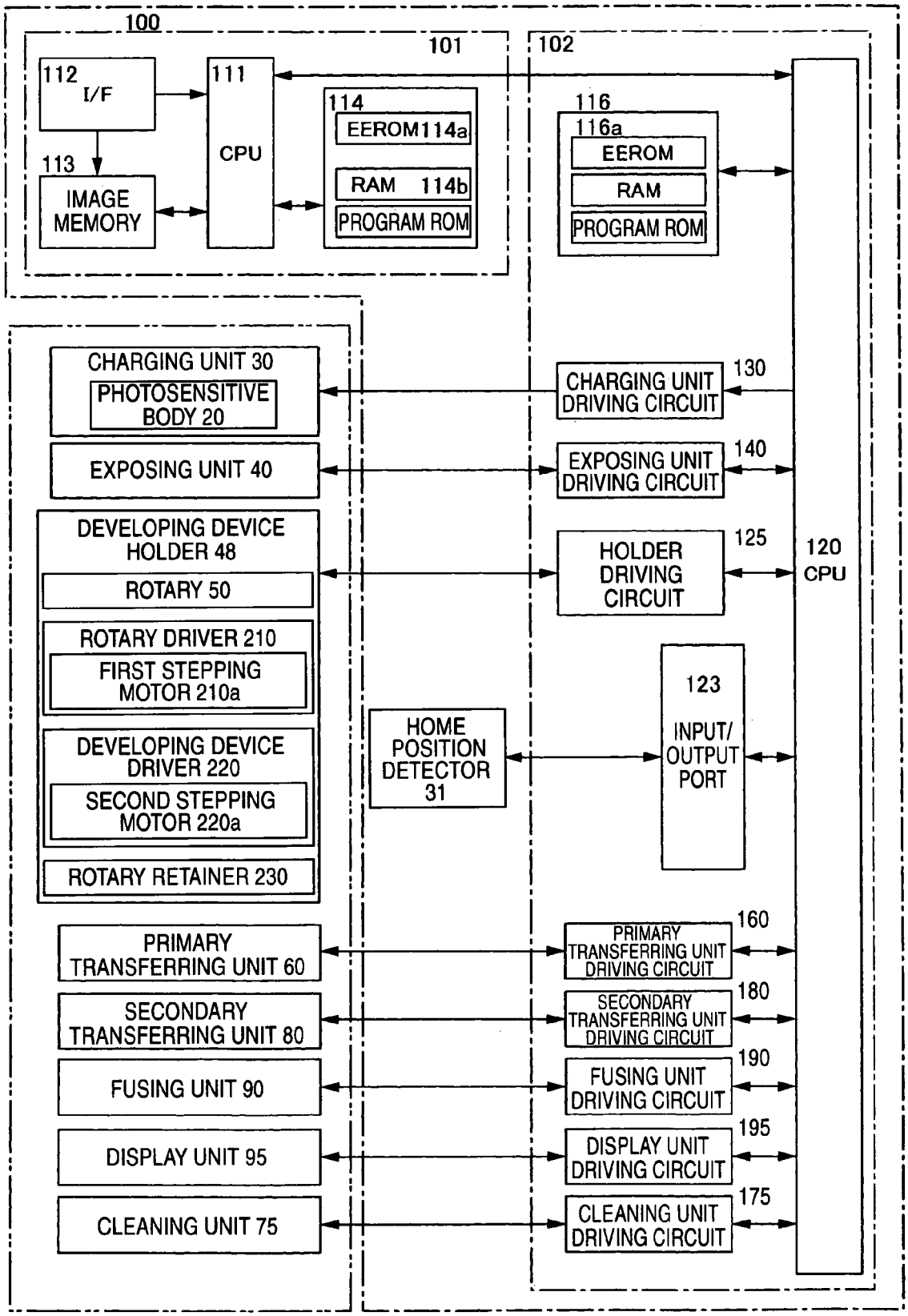
FIG. 8 is a block diagram of a control unit in the printer.

As shown in FIG. 8, the control unit 100 has a main controller 101 and a unit controller 102. An image signal and a control signal are input to the main controller 101, and the unit controller 102 controls the respective units, and the like, in accordance with the image signal and the control signal, to thus form an image.

The main controller 101 includes a CPU 111; an interface 112 used for establishing connection with an unillustrated computer; an image memory 113 for storing an image signal, and the like, input from the computer; and a main controller memory 114. The main controller memory 114 comprises an electrically-rewritable EEPROM 114*a*, a RAM 114*b*, a program ROM provided with programs for use in various control operations, and the like.

The main controller 101 has the function of converting RGB (red, green, and blue) data serving as image signals transmitted from the computer, or the like, into YMCK (yellow, magenta, cyan, and black) image data; and storing the thus-converted YMCK image data in the image memory 113. Meanwhile, in the case where the printer 10 is used as a monochrome printer, the main controller 101 converts the RGB data into black image data, and stores the thus-converted black image data in the image memory 113. In addition, the main controller 101 has the function of transmitting various data to the computer connected therewith.

The EEPROM 114*a* stores mode data indicating whether the printer 10 is to be used as a color printer or a monochrome printer. The CPU 111 receives, at given timing from the unit controller 102, data pertaining to loading of a developing device (hereinafter called "developing device loading data") indicating which one of the four loading sections is equipped with the developing device. The CPU 111 rewrites the mode data in the EEPROM 114*a* in accordance with the loading data, as required. The mode data have already been written in the EEPROM 114*a* in the form of 1-bit data. When the value of the data is 0, the data indicate a color printer. When the value of the data is 1, the data indicate a monochrome printer. When the printer 10 is activated, the main controller 101 detects the power supply and loads the mode data from the EEPROM 114*a* to the RAM 114*b*. Even when the printer 10 is not activated, the mode data are stored in the EEPROM 114*a*.

The unit controller 102 comprises the CPU 120; a unit controller memory 116 including an electrically-rewritable EEPROM 116*a*, a RAM, a program ROM provided with programs for use in various control processes, or the like; and various driving circuits for controlling operations of the respective units of the main body of the printer (i.e., a charging unit driving circuit 130, a exposing unit driving circuit 140, a holder driving circuit 149, a primary transferring unit driving circuit 160, a cleaning unit driving circuit 175, a secondary transferring unit driving circuit 180, and a fusing unit driving circuit 190).

The CPU 120 of the unit controller 102 is electrically connected to the respective driving circuits, and controls the respective driving circuits in accordance with control signals output from the CPU 111 of the main controller 101. More specifically, the CPU 120 receives signals output from sensors provided in the respective units, thereby controlling the respective units in accordance with the signals input from the main controller 101 while detecting the statuses of the respective units.

The CPU 120 also controls the respective driving circuits in accordance with the mode data. Specifically, when the value of the mode data is 0, the CPU 120 controls the respective units of the printer 10 in such a way that the printer functions as a color printer. When the value of the apparatus data is 1, the CPU 120 controls the respective units of the printer 10 in such a way that the printer functions as a monochrome printer.

In the above description, the first stepping motor 210*a* has been explained as being provided with the rotating mode for rotating the developing device holder 48, and the retaining mode for retaining the developing device holder 48 at the stop position. Switching between the two modes is effected by the control unit 100 (more specifically, by a holder driving circuit 125 provided in the unit controller 102). That is, when the first stepping motor 210*a* rotates the rotary 50, the mode of the first stepping motor 210*a* is set to the rotating mode by the holder driving circuit 125; and when the first stepping motor 210*a* retains the rotary 50 at the stop position, the mode of first stepping motor 210*a* is set to the retaining mode by the same.

In addition, the holder driving circuit 125 can change the retaining torque to be exerted by the first stepping motor 210*a* for retaining the rotary 50 at the stop position. The holder driving circuit 125 controls a value of an electric current to be supplied to the first stepping motor 210*a* having been set to the retaining mode, thereby changing the retaining torque. The retaining torque exerted by the first stepping motor 210*a* increases with the current value, and decreases with the same. Accordingly, the holder driving circuit 125 increases or decreases the retaining torque by setting the current value high or low.

In addition, the CPU 120 is also connected to the home position detector 31 via an input/output port 123.

The printer 10 according to the present embodiment is provided with a color-image forming mode capable of forming a full-color image on a medium with use of toner of four colors, and a monochrome-image forming mode capable of forming a monochrome image on a medium with use of black toner.

The image forming operation of the printer 10 will now be described in relation to a case where image forming operations are performed by the printer 10 in the color-image forming mode, and a case where the same are performed in the monochrome-image forming mode, separately. Meanwhile, when the printer 10 is used as the color printer, the printer 10 can implement not only the color-image forming mode, but also the monochrome-image forming mode. Therefore, the image forming operation performed by the printer 10 in implementation of the monochrome-image forming mode, which is described below, is applied to the case where the monochrome-image forming mode is implemented while the printer 10 is being used as the color printer, and to the case where the monochrome-image forming mode is implemented while the printer 10 is being used as the monochrome printer.

First, the image forming operation of the printer 10 in implementation of the color-image forming mode will be described below.

Upon input of image data and a control signal output from the computer to the main controller 101 of the printer 10 by way of the interface 112, the photosensitive body 20 and the intermediate transferring member 70 rotate under control of the unit controller 102 on the basis of an instruction issued from the main controller 102. While being rotated, the photosensitive body 20 is sequentially charged by the charging unit 30 at the charging position.

The thus-charged region on the photosensitive body 20 is brought to an exposing position by rotation of the photosensitive body 20. Then, a latent image in accordance with image data pertaining to the first color (in the present embodiment, black (K)) is formed on the region by the exposing unit 40.

The rotary 50 rotates from the home position (FIG. 7A), and stops at the developing position (FIG. 7B) of the black developing device 51 where the black developing device 51 opposes the photosensitive body 20. The latent image formed on the photosensitive body 20 is brought to a position where development is possible, by rotation of the photosensitive body 20, and is subjected to development with use of the black toner by the black developing device 51. Hence, a black toner image is formed on the photosensitive body 20.

The black toner image formed on the photosensitive body 20 is brought to a primary transferring position by rotation of the photosensitive body 20. At the primary transferring position, the black toner image is transferred onto the intermediate transferring member 70 by the primary transferring unit 60. At this time, a primary transferring voltage, which is of a polarity opposite that to which the toner is charged, is applied to the primary transferring unit 60. Meanwhile, during this operation, the secondary transferring unit 80 is separated from the intermediate transferring member 70.

The above operation is sequentially performed for each of the developing devices of the second color (in the present embodiment, magenta M), the third color (in the present embodiment, cyan C), and the fourth color (in the present embodiment, yellow Y). Hence, toner images of the four colors corresponding to the respective image data are transferred onto the intermediate transferring member 70 in a superimposed manner. As a result, a full-color toner image is formed on the intermediate transferring member 70. Meanwhile, at a time of transition from the processing pertaining to the first color to that pertaining to the second color, the rotary 50 rotates from the developing position (FIG. 7B) of the black developing device 51 to the developing position (FIG. 7C) of the magenta developing device 53. Similarly, the rotary 50 rotates from the developing position (FIG. 7C) of the magenta developing device 53 to the developing position (FIG. 7D) of the cyan developing device 52 at a time of transition from the processing pertaining to the second color to that pertaining to the third color; and the rotary 50 rotates from the developing position (FIG. 7D) of the cyan developing device 52 to the developing position (FIG. 7E) of the yellow developing device 54 at a time of transition from the processing pertaining to the third color to that pertaining to the fourth color. Upon completion of development pertaining to the fourth color, the rotary 50 rotates from the developing position (FIG. 7E) of the yellow developing device 54, to thus return to the home position (FIG. 7A).

The full-color toner image formed on the intermediate transferring member 70 is brought to the secondary transferring position by rotation of the intermediate transferring member 70, and transferred onto a medium by the secondary transferring unit 80. Meanwhile, the medium is transported to the secondary transferring unit 80 from a sheet feeding tray 92 by way of a sheet feeding roller 94 and registration rollers 96. During this transfer operation, the secondary transferring unit 80 is pressed against the intermediate transferring member 70, and a secondary transferring voltage is applied on the secondary transferring unit 80.

The full-color toner image having been transferred onto the medium is heated and pressed by the fusing unit 90, thereby being fused onto the medium.

Meanwhile, after having passed by the primary transferring position, toner T sticking to the surface of the photosensitive body 20 is scraped off by the cleaning blade 76 supported on the cleaning unit 75, whereby the photosensitive body 20 prepares for charging for forming the next latent image. The thus-scraped toner is recovered in a residual-toner recovery section provided in the cleaning unit 75.

Meanwhile, the control signal to be input to the main controller 101 of the printer 10 by way of the interface 112 includes data pertaining a sheet count of a medium on which image forming is to be effected. When the sheet count is two or more, the above-described operation is repeated the number of the count of times. That is, when the count is two or more, a mode for continuously forming full-color images on a plurality of sheets of a medium is performed.

Next, the image forming operation of the printer 10 in implementation of the monochrome-image forming mode will be described below.

Upon input of image data and a control signal output from the computer to the main controller 101 of the printer 10 by way of the interface 112, the photosensitive body 20 and the intermediate transferring member 70 rotate under control of the unit controller 101 on the basis of an instruction issued from the main controller 102. While being rotated, the photosensitive body 20 is successively charged by the charging unit 30 at the charging position.

The thus-charged region on the photosensitive body 20 is brought to the exposing position by rotation of the photosensitive body 20, and a latent image is formed by the exposing unit 40 on the region in accordance with the image data.

The rotary 50 rotates from the foregoing home position (FIG. 7A), and stops at, e.g., the developing position (FIG. 7B) of the black developing device 51 where the black developing device 51 which is loaded to the loading section 50*a*, opposes the photosensitive body 20. The latent image formed on the photosensitive body 20 is brought to a position where development is possible, by rotation of the photosensitive body 20, and is subjected to development with use of the black toner by the black developing device 51. As a result, a black toner image is formed on the photosensitive body 20. Upon completion of the development, the rotary 50 rotates from the developing position (FIG. 7B) of the black developing device 51, to thus return to the home position (FIG. 7A).

The black toner image formed on the photosensitive body 20 is brought to the primary transferring position by rotation of the photosensitive body 20. At the primary transferring position, the black toner image is transferred onto the intermediate transferring member 70 by the primary transferring unit 60. At this time, a primary transferring voltage, which has a polarity opposite that to which the toner is charged, is applied to the primary transferring unit 60. Meanwhile, during this operation, the secondary transferring unit 80 is separated from the intermediate transferring member 70.

The toner image formed on the intermediate transferring member 70 is brought to the secondary transferring position by rotation of the intermediate transferring member 70, and transferred onto the medium by the secondary transferring unit 80. Meanwhile, the medium is transported to the secondary transferring unit 80 from the sheet feeding tray 92 by way of the sheet feeding roller 94 and the registration rollers 96. During this transfer operation, the secondary transferring unit 80 is pressed against the intermediate transferring member 70, and the secondary transferring voltage is applied on the secondary transferring unit 80.

The toner image having been transferred onto the medium is heated and pressed by the fusing unit 90, thereby being fused onto the medium.

Meanwhile, after the photosensitive body 20 has passed by the primary transfer position, the toner T sticking to the surface of the photosensitive body 20 is scraped off by the cleaning blade 76 supported on the cleaning unit 75, whereby turning the photosensitive body 20 into a standby state for the formation of next latent image. The thus-scraped toner is recovered in a residual-toner recovering section provided in the cleaning unit 75.

The control signal to be input to the main controller 101 of the printer 10 by way of the interface 112 includes data pertaining a sheet count of a medium on which image forming is to be effected. When the count is two or more, the above-described operation is repeated a number of times equal to the count. That is, when the count is two or more, a mode for continuously forming monochrome images on a plurality of sheets of medium is performed.

As described above, the first stepping motor 210*a* is provided with not only the function of rotating the rotary 50, but also the function of retaining the rotary 50 at the stop position during a period when the rotary 50 is at a standstill. When the first stepping motor 210*a* retains the rotary 50 at the stop position, the mode of the first stepping motor 210*a* is set to the retaining mode by the holder driving circuit 125. In addition, the holder driving circuit 125 can change the retaining torque to be exerted by the first stepping motor 210*a* when the first stepping motor 210*a* retains the rotary 50 at the stop position by controlling the value of the current to be supplied to the stepping motor 210*a*.

A control operation performed by the holder driving circuit 125 for changing the retaining torque will now be described by reference to FIGS. 9 and 10. There will be described a case where the holder driving circuit 125 changes the retaining torque to be exerted by the first stepping motor 210*a* for retaining the rotary 50 at the stop position shown in FIG. 7B (i.e., the developing position of the black developing device 51). Since the control operation to be performed in implementation of the mode for forming a color image differs from that in implementation of the mode for continuously forming monochrome images, descriptions of both cases will be provided.

Figure 9:
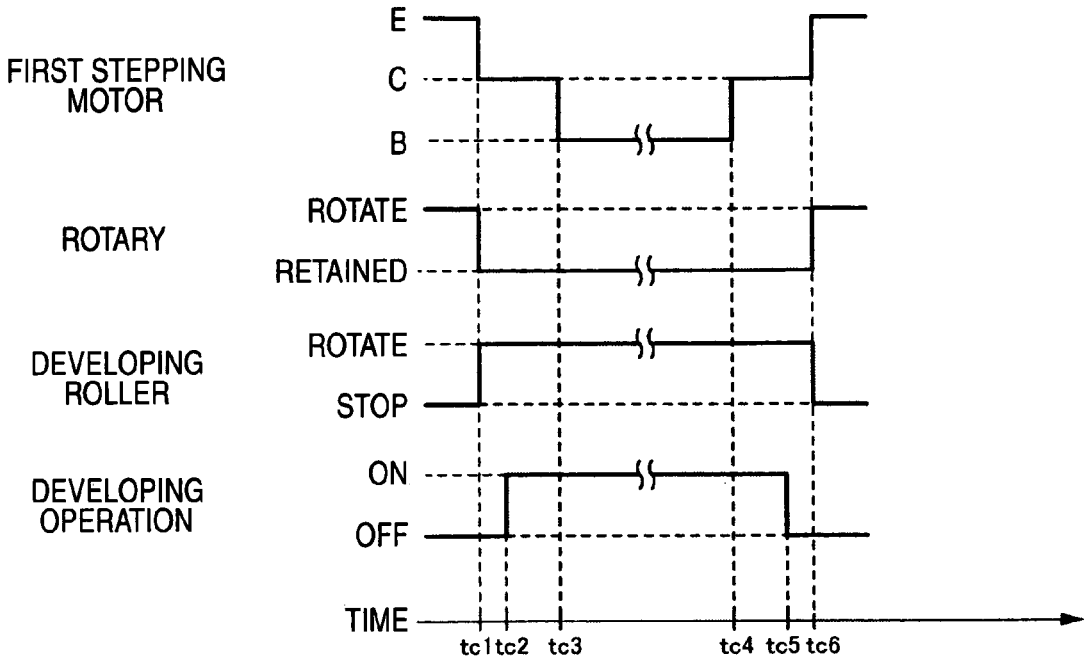
FIG. 9 is a time chart showing a control operation performed in the printer when a mode for forming a color image is effected.

FIG. 9 shows a control operation to be performed in implementation of the mode for forming a color image.

As described above, upon input of image data and a control signal output from the computer to the printer 10, the printer 10 starts the image forming operation. The holder driving circuit 125 sets the mode of the first stepping motor 210*a* to the rotating mode, and controls the first stepping motor 210*a* so that the rotary 50 rotates from the home position (FIG. 7A) and stops at the developing position (FIG. 7B) of the black developing device 51 (time: tc1). Subsequently, at a time when the rotary 50 stops at the developing position (FIG. 7B) of the black developing device 51, the first stepping motor 210*a*, the second stepping motor 220*a*, and the retaining lever 232 perform the following operation under control of the holder driving circuit 125.

The mode of the first stepping motor 210*a* is switched to the retaining mode, and the first stepping motor 210*a* retains the rotary 50 at the developing position. At this time, the value of the current to be supplied to the first stepping motor 210*a* is set to 1.9 A (meanwhile, the retaining torque exerted by the first stepping motor 210*a* in the case where the current value to be supplied to the first stepping motor 210*a* is set to 1.9 A referred to as a value C). The retaining lever 232 is pivoted to thus be fit on the protrusion, thereby retaining the rotary 50 at the developing position. In addition, the second stepping motor 220*a* rotates the developing roller 510 and the toner supplying roller 550. More specifically, the second stepping motor 220*a* supplies the device driving gear 220*c* with a driving force. Upon receipt of this driving force, the device driving gear 220*c* drives (rotates) the developing roller 510 and the toner supplying roller 550 by way of the device driving gear 574 and the intermediate gear 576. Then, the developing operation is started after a while from a start of rotation of the developing roller 510 and the toner supplying roller 550 (time: tc2).

After lapse of a given time period (time: tc3) from the start of driving of the developing roller 510 and the toner supplying roller 550 by the device driving gear 220*c*, the holder driving circuit 125 performs a control operation for reducing the retaining torque. More specifically, the holder driving circuit 125 lowers the value of the current to be supplied to the motor from 1.9 A to 1.3 A, thereby decreasing the value of the retaining torque to be exerted by the first stepping motor 210*a* from the value C to a value B (which is smaller than the value C).

Thereafter, the holder driving circuit 125 increases the retaining torque to be exerted by the first stepping motor 210*a* at time tc4; that is, returns the value of the current to be supplied to the motor from 1.3 A to 1.9 A, thereby increasing the retaining torque value from the value B to the value C. Then, the holder driving circuit 125 controls the first stepping motor 210*a*, and the like, as follows (time: tc6). The developing operation performed by the black developing device 51 terminates at time tc5.

In accordance with the control operation performed by the holder driving circuit 125, the first stepping motor 210*a* discontinues retaining of the rotary 50. In other words, the mode of the first stepping motor 210*a* is switched to the rotating mode by the holder driving circuit 125 (torque exerted in this mode is referred to as a value E). In addition, at this time, the retaining lever 232 is also pivoted to thus be separated from the protrusion, thereby discontinuing retaining of the rotary 50. Furthermore, the second stepping motor 220*a* stops rotation of the developing roller 510 and the toner supplying roller 550. Then, the first stepping motor 210*a* rotates the rotary 50 so as to position the rotary 50 at the next developing position (i.e., the developing position of the magenta developing device 53).

Thereafter, the rotary 50 moves to the developing position of the magenta developing device 53, that of the cyan developing device 52, and that of the yellow developing device 54 sequentially, and the developing operation is performed in a state where the rotary 50 is positioned at each of the developing positions. The same control operation as that described above is also performed at each of the developing positions.

Here, the reason for the holder driving circuit 125 changing the retaining torque to be exerted by the first stepping motor 210*a* as described above will be described. In the following description, for the sake of convenience, during a time period from a start of retaining of the rotary by the first stepping motor 210*a* to a discontinuance thereof (from time tc1 to tc6), a time period from the start of retaining of the rotary by the first stepping motor 210*a* to a start of the control operation performed by the holder driving circuit 125 for decreasing the retaining torque (from time tc1 to tc3) is referred to as an initial stage; a time period from the start of the control operation performed by the holder driving circuit 125 for decreasing the retaining torque to a start of the control operation performed by the same for increasing the retaining torque (from time tc3 to tc4) is referred to as a middle stage; and a time period from the start of the control operation performed by the holder driving circuit 125 for increasing the retaining torque to the time of a discontinuance of retaining of the rotary by the first stepping motor 210*a* (from time tc4 to tc6) is referred to as a final stage.

In the present embodiment, the retaining torque in the initial stage and the final stage is set higher than that in the middle stage. In other words, the retaining torque in the middle stage is lower than that in the initial stage and the final stage.

First, the reason for setting the retaining torque high in the initial stage will be described.

As described above, when the rotary 50 is positioned at the developing position, the device driving gear 220*c* drives the developing roller 510 and the toner supplying roller 550 by way of the device driving gear 574 and the intermediate gear 576. In the present embodiment, the device driving gear 220*c* is rotated clockwise in FIG. 5, thereby rotating the device driving gear 574, which is to be engaged with the device driving gear 220*c*, counterclockwise in FIG. 5. However, at this time, the device driving gear 220*c* unintentionally imparts a force of causing the rotary 50, which is at a standstill at the developing position, to rotate counterclockwise in FIG. 5.

Meanwhile, for a while after driving of the developing roller 510, and the like, is started by the device driving gear 220*c*, a drive torque exerted by the device driving gear 220*c* for driving the developing roller 510, and the like, is likely to be increased for the following reason, which will now be described. First, before driving of the developing roller 510, and the like, is started, toner stored in the toner storage section 530 is highly likely to have been settled by the force of its own weight. In this case, since the toner is solidified, the developing roller 510, and the like, are less easily rotated. In addition, the elastic toner supplying roller 550 is in contact with the developing roller 510 in a state such that the elastic toner supplying roller 550 remains engaged in the developing roller 510. As a result of being left in this state for a long time period, the developing roller 510 and the toner supplying roller 550 have come to less easily rotate. Because of these reasons, for a while after driving of the developing roller 510, and the like, is started by the device driving gear 220*c*, the drive torque required for the device driving gear 220*c* is likely to be increased. When the drive torque is high, the above-described force required for the device driving gear 220*c* for rotating the rotary 50 counterclockwise in FIG. 5 also becomes large. Therefore, the retaining torque to be exerted by the first stepping motor 210*a* must be increased in the initial stage.

In contrast, the middle stage is free from the above-described circumstances. Therefore, in the middle stage, more importance is placed on suppression of power consumption, and the retaining torque to be exerted by the first stepping motor 210*a* is decreased as compared with that in the initial stage. In other words, since the value of the current to be supplied to the first stepping motor 210*a* is decreased so as to lower the retaining torque, power consumption can be suppressed appropriately. In addition, suppression of power consumption also derives an advantage that a quantity of heat released from the first stepping motor 210*a* can be suppressed.

Next, the reason for setting the retaining torque to be exerted by the first stepping motor 210*a* high in the final stage will be described. In the middle stage, since the retaining torque to be exerted by the first stepping motor 210*a* is set low for placing more importance on suppression of power consumption, the device driving gear 220*c* drives the developing roller 510 and the toner supplying roller 550 by way of the device driving gear 574, and the like, in a state in which the retaining torque is low. Therefore, under such a state, the rotary 50 may rotate counterclockwise in FIG. 5 against the retaining torque. Meanwhile, as described above, in conjunction with retaining of the rotary 50 by the first stepping motor 210*a*, the retaining lever 232 also retains the rotary 50 by fitting on the protrusion in the present embodiment. However, the rotary 50 can rotate counterclockwise in FIG. 5 by a minute amount even when the retaining lever 232 fits on the protrusion because of the following reasons: a small gap is provided between the recess 232*b* in the retaining lever 232 and the protrusion for reasons related to manufacturing, and the like; and the retaining lever 232 stretches or deforms by a slight extent because of being made of a resin.

When the rotary 50 rotates counterclockwise in FIG. 5 by a minute amount, the following inconveniences may arise. That is, when the rotary 50 rotates counterclockwise in FIG. 5 by a minute amount, the rotary driving gear 210*b* engaged with the rotary 50, and the motor shaft 210*c* to which the rotary driving gear 210*b* is fixed also rotate, thereby rotating a rotor of the first stepping motor 210*a* by a minute amount. More specifically, the following inconvenience may arise. That is, the rotor of the first stepping motor 210*a* moves to a position deviated from a desired position (a position of the rotor before the rotary 50 rotates counterclockwise in FIG. 5). When the mode of the first stepping motor 210*a* is switched to the rotating mode with such a state continuing, and an instruction for rotating the rotary 50 is issued to the first stepping motor 210*a* from the holder driving circuit 125, the first stepping motor 210*a* malfunctions (e.g., even when an instruction for rotating the rotary 50 counterclockwise is issued, the rotary 50 rotates clockwise).

Therefore, for the purpose of avoiding such an inconvenience, the retaining torque to be exerted by the first stepping motor 210*a* is increased in the final stage by increasing the value of the current to be supplied to the first stepping motor 210*a*. By virtue of this control operation, a magnetic force of the electromagnet in a stator provided in the first stepping motor 210*a* is increased. Hence, the rotor having been deviated from the desired position in the middle stage is returned to the desired position by the magnetic force, thereby appropriately preventing occurrence of a malfunction. More specifically, when, after having increased the retaining torque to be exerted by the first stepping motor 210, the holder driving circuit 125 switches the mode of the first stepping motor 210*a* to the rotating mode, and issues the instruction to the first stepping motor 210*a* for rotating the rotary 50, the rotor of the first stepping motor 210*a* is to return to its desired position, and thereafter start to rotate. Consequently, the first stepping motor 210*a* operates appropriately.

As described above, in the printer 10 according to the present embodiment, the retaining torque to be exerted by the first stepping motor 210*a* during a period when the first stepping motor 210*a* retains the rotary 50 at the developing position is changed by the holder driving circuit 125. By virtue of this control operation, there can be realized the printer 10 which can suppress electric power consumption appropriately.

For instance, when the holder driving circuit 125 is not provided with the function of the retaining torque, the retaining torque during a period ranging from the initial stage to the final stage in the above control operation must be set high (i.e., the value of the retaining torque must be set to the value C instead of the value B during the period from the start of retaining of the rotary by the first stepping motor 210*a* to the discontinuance of the same). When this control operation is employed, in contrast to the present embodiment, the value of the retaining torque becomes large even in the middle stage, thereby increasing power consumption. On the other hand, in the present embodiment, the value of the retaining torque can be caused to be small, thereby suppressing power consumption appropriately. In addition, by virtue of this control operation, there is derived an advantage that a quantity of heat released from the first stepping motor 210*a* can be suppressed.

Figure 10:
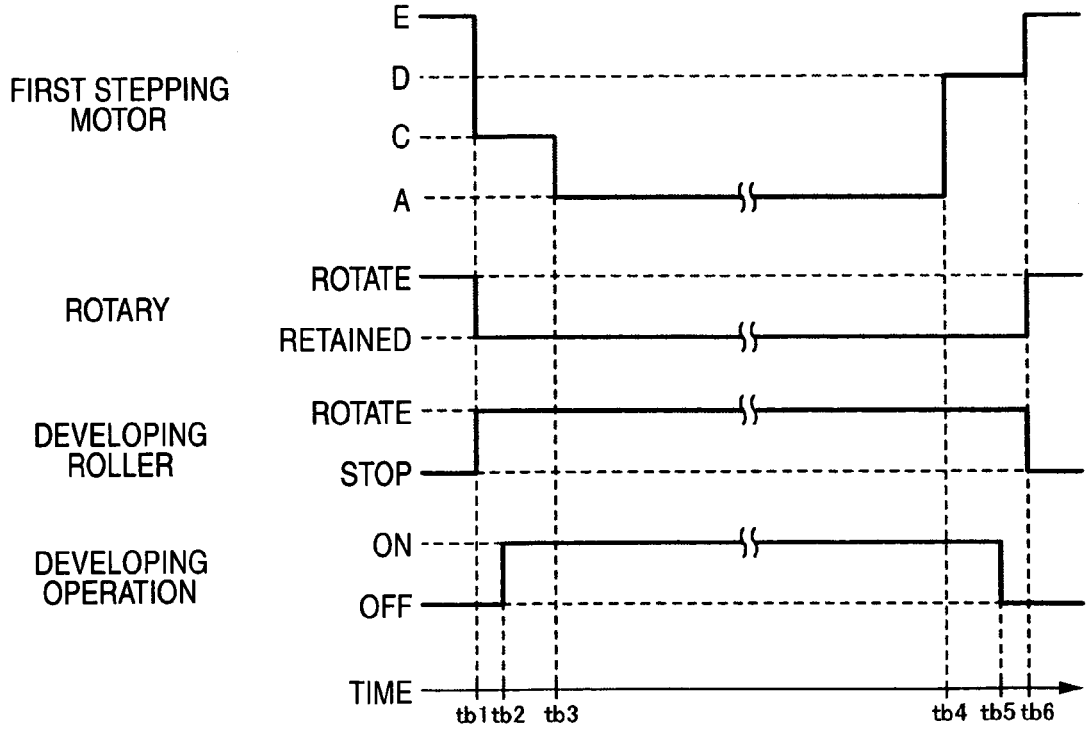
FIG. 10 is a time chart showing a control operation performed in the printer when a mode for continuously forming monochrome images is effected.

FIG. 10 shows a control operation to be performed in implementation of the mode for continuously forming monochrome images.

As described above, upon input of image data and a control signal output from the computer to the printer 10, the printer 10 starts the image forming operation. The holder driving circuit 125 sets the mode of the first stepping motor 210*a* to the rotating mode, and controls the first stepping motor 210*a* so that the rotary 50 rotates from the home position (FIG. 7A) and stops at the developing position (FIG. 7B) of the black developing device 51 (time: tb1). Subsequently, at a time when the rotary 50 stops at the developing position (FIG. 7B) of the black developing device 51, the first stepping motor 210*a*, the second stepping motor 220*a*, and the retaining lever 232 perform the following control operation under control of the holder driving circuit 125.

The mode of the first stepping motor 210*a* is switched to the retaining mode, and the first stepping motor 210*a* retains the rotary 50 at the developing position. At this time, the value of the current to be supplied to the first stepping motor 210*a* is set to 1.9 A (the value C). The retaining lever 232 is pivoted to thus be fit on the protrusion, thereby retaining the rotary 50 at the developing position. In addition, the second stepping motor 220*a* rotates the developing roller 510 and the toner supplying roller 550. More specifically, the second stepping motor 220*a* supplies the device driving gear 220*c* with a driving force. Upon receipt of this driving force, the device driving gear 220*c* drives (rotates) the developing roller 510 and the toner supplying roller 550 by way of the device driving gear 574 and the intermediate gear 576. After a while from a start of rotation of the developing roller 510 and the toner supplying roller 550, the developing operation is started (time: tb2).

After lapse of a given time period (time: tb3) from the start of driving of the developing roller 510 and the toner supplying roller 550 by the device driving gear 220*c*, the holder driving circuit 125 performs the control operation for reducing the retaining torque. More specifically, the holder driving circuit 125 lowers the value of the current to be supplied to the motor from 1.9 A to 0.1 A, thereby decreasing the value of the retaining torque to be exerted by the first stepping motor 210*a* from the value C to a value A (less than the values B and C).

Thereafter, the holder driving circuit 125 increases the retaining torque to be exerted by the first stepping motor 210*a* at time tb4; that is, returns the value of the current to be supplied to the motor from 0.1 A to 3.0 A, thereby increasing the retaining torque value from the value B to a value D (greater than the value C). Then, the holder driving circuit 125 controls the first stepping motor 210*a*, and the like, as follows (time: tb6). The developing operation performed by the black developing device 51 terminates at time tb5.

In accordance with the control operation performed by the holder driving circuit 125, the first stepping motor 210*a* discontinues retaining of the rotary 50. In other words, the mode of the first stepping motor 210*a* is switched to the rotating mode by the holder driving circuit 125. In addition, at this time, the retaining lever 232 is pivoted to thus be separated from the protrusion, thereby discontinuing retaining of the rotary 50. Furthermore, the second stepping motor 220*a* stops rotation of the developing roller 510 and the toner supplying roller 550. Then, the first stepping motor 210*a* rotates the rotary 50 so as to position the rotary 50 at the home position. When the rotary 50 is positioned at the home position, the printer 10 enters a standby state.

There will be described below the reason why the control operation performed when the mode for continuously forming monochrome images is implemented is made different from that performed when the mode for forming a color image is implemented. Also here, for the sake of convenience, during a time period from a start of retaining of the rotary by the first stepping motor 210*a* to a discontinuance thereof (from time tb1 to tb6), a time period from the start of retaining of the rotary by the first stepping motor 210*a* to a start of the control operation performed by the holder driving circuit 125 for decreasing the retaining torque (from time tb1 to tb3) is referred to as an initial stage; a time period from the start of the control operation performed by the holder driving circuit 125 for decreasing the retaining torque to a start of the control operation performed by the same for increasing the retaining torque (from time tb3 to tb4) is referred to as a middle stage; and a time period from the start of the control operation performed by the holder driving circuit 125 for increasing the retaining torque to the time when the first stepping motor 210*a* has discontinued retaining of the rotary (from time tb4 to tb6) is referred to as a final stage.

In this mode, the retaining torque in the middle stage (value A) is lower than that (value B) in the middle stage where the color-image forming mode is implemented.

In implementation of the mode for continuously forming monochrome images, the developing operation by the black developing device 51 is performed continuously for a longer period than that when the color-image forming mode is implemented. When the developing operation is performed continuously for a long time, driving operations of the developing roller 510 by the device driving gear 220*c*, and the like, are gradually stabilized. Therefore, in this mode, even when the rotor of the first stepping motor 210*a* is moved to a position deviated from a desired position, since the driving operations are stabilized, the rotor is likely to return to the desired position by itself.

Accordingly, in this mode, more importance is placed on suppression of the power consumption, and the retaining torque in the middle stage is caused to be lower than that when the color-image forming mode is implemented.

In addition, as another dissimilarity, the retaining torque in the final stage of this mode (value D) is higher than that (value C) in the final stage of the color-image forming mode.

In this mode, even when the rotor of the first stepping motor 210*a* is moved to a position deviated from a desired position, the rotor is likely to return to the desired position by itself. However, since the retaining torque in the middle stage of this mode is set to be lower than that of the color-image forming mode, the retaining torque in this mode is caused to be higher as insurance against a case where the rotor has failed to return to the desired position.

In a case where a monochrome-image forming mode (i.e., a mode for forming a monochrome image on a single medium) is implemented, the same control operation as that performed in the color-image forming mode is performed.

The image forming apparatus, and the like, according to the present invention has hitherto been described by reference to the embodiment. However, the above-described embodiment of the invention aims at facilitating understanding of the invention, and should not be construed as limiting the range of the invention. As a matter of course, the invention can be changed and modified without departing from the scope of the invention, and equivalents thereof are included in the invention.

The above embodiment has been described while taking a printer which can be used both as a color printer and as a monochrome printer, as an example of the image forming apparatus. However, the image forming apparatus is not limited thereto. The present invention can be applied to an ordinary color printer or an ordinary monochrome printer. Alternatively, the present invention can be applied to an image forming apparatus of a variety of types, such as a copying machine or a facsimile.

In the above embodiment, the photosensitive body serving as an image carrier has been described as having a configuration of a photosensitive layer being provided on an outer circumferential surface of the cylindrical conductive substrate. However, the photosensitive body may be a so-called photosensitive belt having a configuration of a photosensitive layer being provided on the surface of a belt-shaped conductive substrate.

In the above embodiment, development of a latent image is performed in black, magenta, cyan, and yellow, in the thus-listed order. However, the order in which the development is performed is not limited thereto.

In addition, in the above embodiment, the holder driving circuit 125 controls the value of the current to be supplied to the first stepping motor 210*a*, thereby changing the retaining torque. However, the holder driving circuit 125 may control the value of voltage to be applied to the first stepping motor 210*a*, thereby changing the retaining torque.

In the above embodiment, when a latent image is to be developed by the developing device, the rotary 50 stops at the given developing position; the first stepping motor 210*a* retains the rotary 50 at the developing position; and the holder driving circuit 125 changes the retaining torque to be exerted by the first stepping motor 210*a* for retaining the rotary 50 at the developing position. However, the following configuration may be employed: the first stepping motor 210*a* retains the rotary 50 at the home position or the replacement position; and the holder driving circuit 125 changes the retaining torque to be exerted by the first stepping motor 210*a* for retaining the rotary 50 at the home position or the replacement position.

In the above embodiment, the developing device is provided with the elastic toner supplying roller 550 which comes into contact with the developing roller 510, thereby supplying toner to the developing roller 510. However, the developing device may not be provided with the toner supplying roller 550.

In the above embodiment, the printer 10 has the retaining lever 232 which fits on the protrusion of the rotary 50 during a period when the rotary 50 is at a standstill, thereby retaining the rotary 50 at the stop position. However, the printer 10 may not be provided with the retaining lever 232.

In the above embodiment, the retaining lever 232 is made of a resin. However, the retaining lever may be made of a metal.

Next, an image forming system incorporating the above image forming apparatus will be described.

Figure 11:
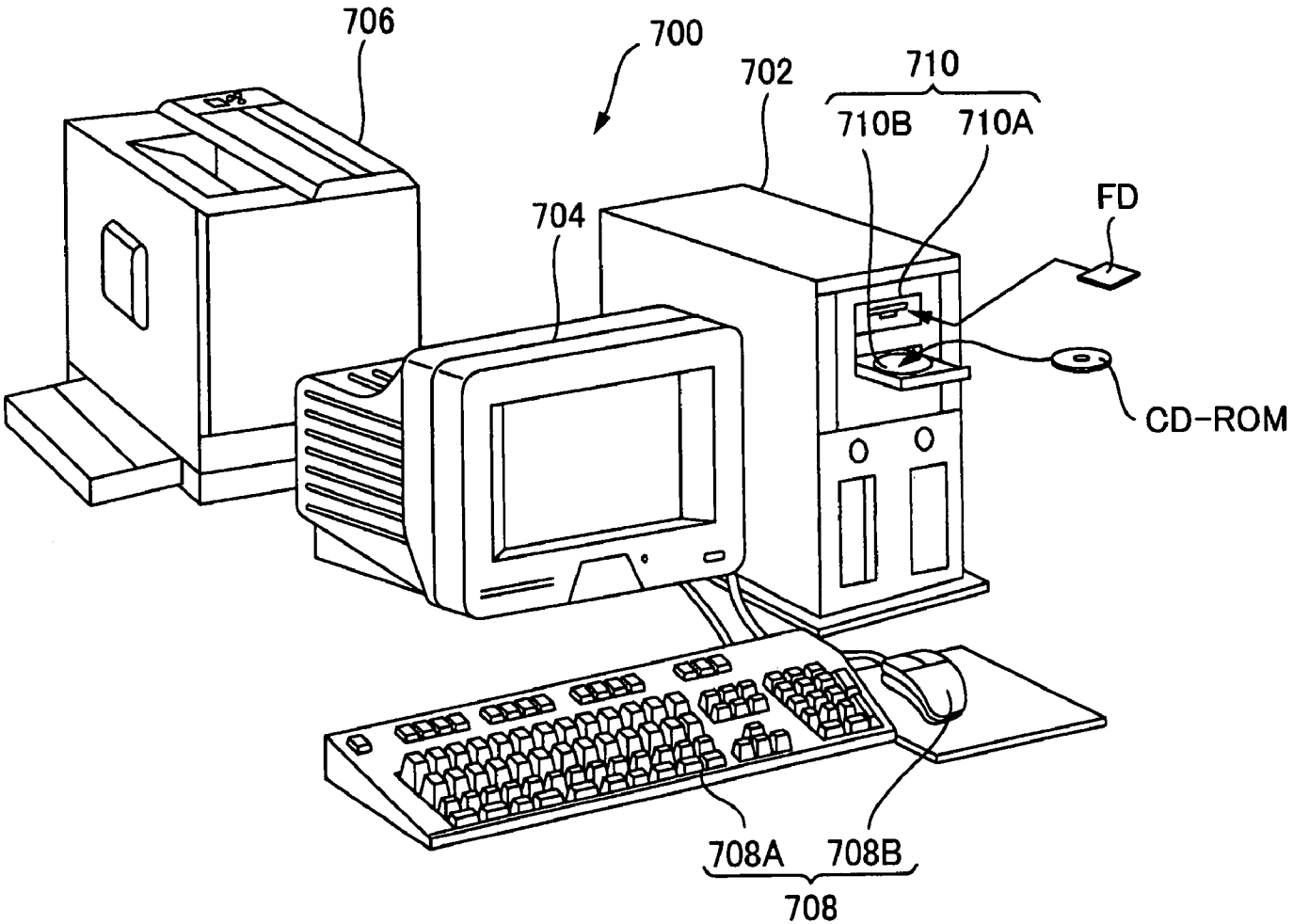
FIG. 11 is a perspective view of an image forming system incorporating the printer.

As shown in FIG. 11, an image forming system 700 comprises a computer 702, a display device 704, the printer 10, input devices 708, and reading devices 710.

The computer 702 of the present embodiment is enclosed in a mini-tower-type enclosure; however, the configuration is not limited to this type. A CRT (cathode ray tube), a plasma display, a liquid crystal display device, or the like, is generally employed for the display device 704; however, the display device is not limited to them. A keyboard 708A and a mouse 708B are employed in the embodiment as the input devices 708; however, the input devices are not limited to them. A flexible disk drive device 710A and a CD-ROM drive device 710B are employed in the embodiment as the reading devices 710; however, the reading devices are not limited to them. For instance, another device, such as an MO (magneto optical) disk drive, or a DVD (digital versatile disk), or the like may also be employed.

Figure 12:
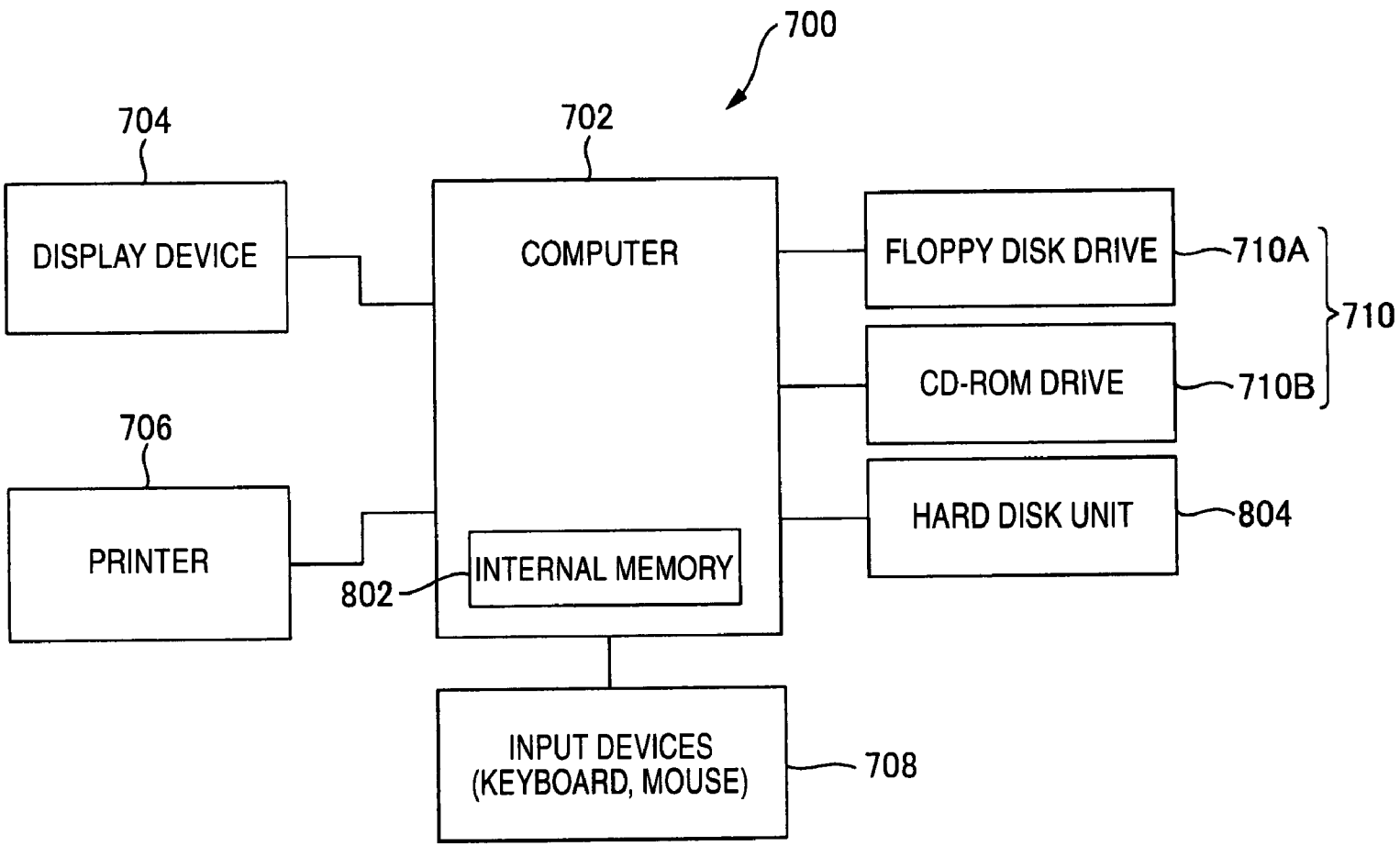
FIG. 12 is a block diagram showing the image forming system.

As shown in FIG. 12, an internal memory 802 such as a RAM and an external memory such as a hard disk drive unit 804 are further provided in the enclosure where the computer 702 is enclosed.

Alternatively, e.g., the printer 10 may include portions of functions or mechanisms of the computer 702, the display device 704, the input devices 708, and the reading devices 710. As an example configuration, the printer 10 may include an image forming section for effecting image processing, a display section for performing a variety of display operations, a recording medium loading section for removably loading a recording medium where image data having been captured by a digital camera, or the like, are recorded, and the like.

Alternatively, e.g., the printer 706 may include a portion of each function or mechanism of the computer 702, the display device 704, the input device 708, and the reader 710. As an example configuration, the printer 706 may include an image forming section for effecting image processing, a display section for performing a variety of display operations, a recording-medium-loading/detachment section for attaching/detaching a recording medium in which image data having been captured by a digital camera, or the like, are recorded, and the like.

The image forming system realized as described above becomes superior to the related-art system in terms of overall execution.

What is claimed is:

1. An image forming apparatus, comprising:

a rotary member, having a plurality of loading sections each of which is adapted to accommodate a developing device operable to develop an electrostatic latent image formed on an image carrier, the rotary member being rotatable between a plurality of stop positions;

a motor, operable to exert a torque on the rotary member, the torque including a first torque, a second torque lower than the first torque, and a third torque lower than the second torque; and a controller, operable to cause the motor to exert the first torque to rotate the rotary member, and to cause the motor to exert the second torque and the third torque interchangeably while the rotary member is retained at one of the stop positions.

2. The image forming apparatus as set forth in claim 1, wherein:

the controller controls current supplied to the motor to exert one of the first torque, the second torque, and the third torque.

3. The image forming apparatus as set forth in claim 1, wherein:

the stop positions includes a position that the developing device accommodated in one of the loading sections is opposed to the image carrier.

4. The image forming apparatus as set forth in claim 1, wherein:

the motor is a stepping motor; and the controller causes the motor to increase the torque from the third torque to the second torque before the rotary member is rotated.

5. The image forming apparatus as set forth in claim 1, wherein:

the torque includes a fourth torque lower than the third torque; and the controller causes the motor to exert the fourth torque in a case where a color of developing agent contained in the developing device accommodated in one of the loading sections is identical with a color of developing agent contained in the developing device accommodated with any one of the loading sections, and a plurality of monochrome images are continuously formed.

6. The image forming apparatus as set forth in claim 5, wherein:

the motor is a stepping motor;

the torque includes a fifth torque lower than the first torque but higher than the second torque; and the controller causes the motor to increase the torque from the fourth torque to the fifth torque before the rotary member is rotated.

7. The image forming apparatus as set forth in claim 1, further comprising:

a roller driver, adapted to rotate a developing roller provided in the developing device which is operable to supply developing agent to the image carrier to develop the latent image, wherein:

the controller causes the motor to decrease the torque from the second torque to the third torque after the roller driver starts rotating the developing roller.

8. The image forming apparatus as set forth in claim 1, further comprising:

a plurality of engagement members, each of which is associated with one of the stop positions and is provided on the rotary member; and a retainer, operable to engage with one of the engagement members when the rotary member is placed in one of the stop positions.

9. The image forming apparatus as set forth in claim 8, wherein:

the retainer is comprised of resin.

10. An image forming system, comprising:

the image forming apparatus as set forth in claim 1; and a computer, communicatively connected to the image forming apparatus and operable to cause the image-forming apparatus to execute an image forming operation.

* * * * *